US009968839B2

(12) United States Patent
Davenport

(10) Patent No.: US 9,968,839 B2
(45) **Date of Patent: *May 15, 2018**

(54) GOLF SWING MEASUREMENT AND ANALYSIS SYSTEM

(71) Applicant: Golf Impact LLC, Fort Lauderdale, FL (US)

(72) Inventor: Roger Davenport, Fort Lauderdale, FL (US)

(73) Assignee: Golf Impact, LLC, Fort Lauderdale, FL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/299,356

(22) Filed: Oct. 20, 2016

(65) Prior Publication Data

US 2017/0036090 A1 Feb. 9, 2017

Related U.S. Application Data

(60) Continuation of application No. 13/686,618, filed on Nov. 27, 2012, now Pat. No. 9,504,895, which is a division of application No. 13/273,216, filed on Oct. 13, 2011, which is a continuation of application No. 13/269,603, filed on Oct. 9, 2011, which is a continuation-in-part of application No. 12/287,303, filed on Oct. 9, 2008, now Pat. No. 9,084,925.

(51) Int. Cl.

| | |
|---|---|
| ***A63B 69/36*** | (2006.01) |
| ***A63B 24/00*** | (2006.01) |
| ***A63B 53/04*** | (2015.01) |
| *A63B 71/06* | (2006.01) |

(52) U.S. Cl.

CPC ..... *A63B 69/3614* (2013.01); *A63B 24/0006* (2013.01); *A63B 53/04* (2013.01); *A63B 53/0466* (2013.01); *A63B 69/36* (2013.01); *A63B 69/3632* (2013.01); *A63B 2071/063* (2013.01); *A63B 2071/0625* (2013.01); *A63B 2220/00* (2013.01); *A63B 2220/40* (2013.01); *A63B 2220/53* (2013.01); *A63B 2220/56* (2013.01); *A63B 2225/50* (2013.01); *Y10T 29/49002* (2015.01)

(58) Field of Classification Search

CPC ..... A63B 69/3632; A63B 69/3614

See application file for complete search history.

(56) References Cited

U.S. PATENT DOCUMENTS 4,660,039 A 4/1987 Barricks et al.
4,898,389 A 2/1990 Plutt
(Continued)

*Primary Examiner* — Kang Hu
*Assistant Examiner* — Syvila Weatherford
(74) *Attorney, Agent, or Firm* — Whiteford, Taylor & Preston, LLP; Gregory M. Stone

(57) ABSTRACT

A golf club head includes a club face with at least one impact sensor, where the sensor has a passive piezoelectric element that is integrated into the club face, the passive piezoelectric element being able to generate a signal when an impact force is applied to the club face. An energy storage assembly includes a battery, a capacitor, or both. An energy harvesting assembly includes a signal divider with at least one input and at least two outputs, the at least two outputs providing a known ratio of a given input signal, wherein the at least one input of the signal divider is electrically coupled to one or more of the piezoelectric elements and a first of the at least two signal divider outputs is electrically coupled to the energy storage assembly.

20 Claims, 16 Drawing Sheets

(56) References Cited

U.S. PATENT DOCUMENTS

| | | | |
|---|---|---|---|
| 5,355,142 | A | 10/1994 | Marshall et al. |
| 5,547,427 | A | 8/1996 | Rigal et al. |
| 5,941,782 | A | 8/1999 | Cook |
| 5,997,415 | A | 12/1999 | Wood |
| 6,002,370 | A | 12/1999 | Mckinnon et al. |
| 6,196,932 | B1 | 3/2001 | Marsh et al. |
| 6,248,021 | B1 | 6/2001 | Ognjanovic |
| 6,400,308 | B1 | 6/2002 | Bell et al. |
| 6,428,427 | B1 | 8/2002 | Kosmatka |
| 6,435,982 | B1 | 8/2002 | Galloway et al. |
| 6,709,344 | B2 | 3/2004 | Erickson et al. |
| 7,691,004 | B1 | 4/2010 | Lueders |
| 7,736,242 | B2 | 6/2010 | Stites et al. |
| 9,084,925 | B2 | 7/2015 | Davenport et al. |
| 2002/0049095 | A1 | 4/2002 | Galloway et al. |
| 2004/0132505 | A1 | 7/2004 | Leclerc et al. |
| 2005/0037862 | A1 | 2/2005 | Hagood et al. |
| 2005/0093700 | A1 | 5/2005 | Carrender |
| 2005/0122265 | A1 | 6/2005 | Gaucher et al. |
| 2005/0215340 | A1 | 9/2005 | Stites et al. |
| 2006/0052173 | A1 | 3/2006 | Telford |
| 2006/0128503 | A1 | 6/2006 | Savarese et al. |
| 2006/0254116 | A1 | 11/2006 | Holmberg |
| 2006/0264264 | A1 | 11/2006 | Sandino |
| 2006/0276256 | A1 | 12/2006 | Storek |
| 2006/0287126 | A1 | 12/2006 | Aisenbrey |
| 2007/0091004 | A1 | 4/2007 | Puuri |
| 2008/0042908 | A1 | 2/2008 | Rausch |
| 2008/0085778 | A1 | 4/2008 | Dugan |
| 2008/0176673 | A1 | 7/2008 | Morales et al. |
| 2009/0023511 | A1 | 1/2009 | Meyer et al. |
| 2009/0085810 | A1 | 4/2009 | Soler Castany et al. |
| 2009/0120197 | A1 | 5/2009 | Golden et al. |
| 2009/0143159 | A1 | 6/2009 | Murph et al. |
| 2009/0165530 | A1 | 7/2009 | Golden et al. |
| 2009/0197699 | A1 | 8/2009 | Morris et al. |
| 2009/0209358 | A1 | 8/2009 | Niegowski |
| 2009/0326688 | A1 | 12/2009 | Thomas et al. |
| 2010/0045241 | A1 | 2/2010 | Nousiainen |
| 2010/0049468 | A1 | 2/2010 | Papadourakis |
| 2011/0095652 | A1 | 4/2011 | Winger et al. |
| 2011/0230986 | A1 | 9/2011 | Lafortune et al. |
| 2011/0247190 | A1 | 10/2011 | Evans et al. |
| 2011/0269567 | A1 | 11/2011 | Ban et al. |
| 2011/0312437 | A1 | 12/2011 | Sargent et al. |
| 2012/0032518 | A1 | 2/2012 | Huang et al. |
| 2012/0046119 | A1 | 2/2012 | Davenport |
| 2012/0100923 | A1 | 4/2012 | Davenport |
| 2012/0277018 | A1 | 11/2012 | Boyd et al. |
| 2013/0085007 | A1 | 4/2013 | Davenport |

GOLF SWING MEASUREMENT AND ANALYSIS SYSTEM

CROSS-REFERENCE TO RELATED APPLICATION

This patent application is continuation application of U.S. patent application Ser. No. 13/686,618 filed on Nov. 27, 2012 and entitled "Golf Swing Measurement and Analysis System," which is a divisional application of U.S. patent application Ser. No. 13/273,216 filed on Oct. 13, 2011 and entitled "Golf Swing Measurement and Analysis system," which is a continuation application of U.S. patent application Ser. No. 13/269,603 filed Oct. 9, 2011, entitled "Golf Swing Measurement and Analysis System," which is a continuation-in-part application of U.S. patent application Ser. No. 12/287,303 filed Oct. 9, 2008 and entitled "Golf Swing Analysis Apparatus and Method," the entire contents of which are incorporated herein by reference.

FIELD OF THE INVENTION

The present invention relates to a measurement and analysis system for determining the effectiveness of a golfer's swing based on all measurements made at the golf club head.

BACKGROUND OF THE INVENTION

Golf swing analysis systems and concepts for swing analysis systems have exited for many years. The existing systems typically have sensors attached to or within the club head or the club shaft or both and many communicate information wirelessly.

A system shown in U.S. Pat. No. 7,736,242 to Stites, shows an integrated golf club with acceleration sensors on the shaft and in the club head and communicates wirelessly. The system also discloses a club head with an impact module that may include a strain gage. The system in U.S. Pat. No. 7,736,242 does not teach or suggest an integrated electronic system golf clubhead that integrates impact sensors into the club head face in combination with acceleration measurement sensors located in the club head and further does not teach an antenna system that utilizes the electrical properties and shape of the club head as an integral component element of the antenna system design to increase power efficiency and further operating time duration based on storage capacity of energy device.

Another example of attaching sensors to a golf club is shown in U.S. Pat. No. 4,898,389 to Plutt, who claims a self-contained device for indicating the area of impact on the face of the club and the ball, and a means for an attachable and detachable sensor or sensor array that overlies the face of the club. Plutt's device does not provide for an imbedded impact sensor array in the clubface that functions in conjunction with internal three dimensional g-force sensors to provide a superset of time varying spatial force impact contours of the clubface with club head acceleration force parameters that can be calibrated for highly accurate spatial and force measurement. Plutt's device is susceptible to location inaccuracy due to the removable constraint of the sensors and is susceptible to sensor damage since the sensors come in direct contact with the ball.

These systems fail to teach or suggest a self-contained integrated electronic system golf club head comprising the functions and methods of: measuring three orthogonal acceleration axes across time with accelerometer(s) from within the club head and measuring club face impact location and club face force profile(s) with impact sensor within the club face and support electronics with wireless communication capabilities located in club head that further facilitate transmit and receive functions through an antenna system that utilized the club head as an integral electrical element component of the antenna system to enable efficient electrical power usage that further enables a light weight combination of sensors and electronics and energy source that further enables the proper weight of an integrated golf club head comprising the combination of sensors and electronics and energy sources and club head shell structure that results in substantially the same physical performance characteristics of the overall system golf club head with respect to weight, center of gravity and coefficient of restitution as a regulation club head of similar type.

Examples of golf club head types include but not limited to: a driver golf club head type, a wood golf club head type, a hybrid golf club head type, an iron golf head type or a putter golf club head type. In addition, the club head must be made at least in part of an electrically conducting material such as aluminum, titanium or any other metal or alloy or combination of metals or alloys or a combination.

SUMMARY OF THE INVENTION

The present invention is an integrated golf club that measures swing performance characteristics with three orthogonal acceleration measurements and impact pressure sensor measurements integrated into the golf club head and further wirelessly transmits and receives radio wave signals from golf club head using an antenna system comprising two or more electrically conductive elements and at least one electrically non-conductive object, and further first electrically conductive element is an electrically conductive golf club head. Further, integrated electronics system golf club head has substantially the same coefficient of restitution and weight and center of gravity as a regulation play golf club head of similar type.

The present invention is an integrated golf club that comprises an integrated electronic system golf club head that is attachable and detachable to a golf club shaft and the integrated electronic system golf club head has substantially the same physical and performance characteristics as a regulation golf club head of similar type. The integrated electronic system golf club head measure three orthogonal axis of acceleration during the entire swing and measures ball/club face impact force profiles distributed across club face throughout the time duration of the impact and both types of measurement are synchronized on a single time line. Further the integrated electronic system golf club head communicates wirelessly using radio waves between itself and a user interface device. The transmission and reception of radio wave from the club head is efficiently facilitated by an integrated antenna system that by design defines and utilizes attributes including physical structure and electrical properties of the club head shell in the overall antenna system design. The integrated electronic system golf club head shell also serves as the physical structure for enclosing and mounting assemblies that provide the system functions including: sensing, data capture and processing, memory, communication signal wave generation and data formatting for wireless transmission and reception along with an energy source to operate the electronics.

The benefits of an integrated electronic system golf club head is that it can perform substantially similar to that of a regulation golf club head of same type, while providing essential measurements of swing and or impact performance characteristics to the golfer reliably over a time period that is of adequate length for a training session or round of golf. These requirements translated into an integrated electronics system golf club head with substantially the same physical properties of a similar type golf club head with regards to weight, center of gravity and structural impact performance. The integrated electronics system golf club head comprises a number of assemblies that include club face assembly including impact sensors, antenna system assembly including club head shell, electronics assembly, three dimensional acceleration sensor(s) assembly and energy source assembly. These assemblies all have a defined mass and weight that when assembled provide substantially the same coefficient of restitution, weight and center-of-gravity as a regulation golf club head of similar type. Therefore, this drives the requirement that the electronic measurement and communication support function assemblies be a light as possible while performing their required functions accurately and reliably over a defined period of time so enough mass of material is available for the club head shell structure to provide mechanical structural performance requirements to function as a high performance golf club head. To achieve the lightest weight electronic and support assemblies possible, the electronic component parts count must be minimized, and the electronic design including all processing and wireless communication must be optimized for power efficiency to reduce the size and weight of the energy source required to operate the electronics system for an adequate period of time. This invention is an integrated electronic system golf club head that preserves the golf club head physical performance properties and further utilizes the golf club head shell physical structure and electrical properties to reduce parts count, materials and improve power efficiency of the electronic processing and communication functions to reduce the physical weight of electronics while providing accurate and reliable measurement and wireless communication performance. Further, when integrated electronic system golf club head is combined with a golf club shaft with grip the combination become a complete golf swing and impact measurement system.

The first category of measured forces includes three dimensional motional acceleration forces at the club head during the entire golf swing including impact. The relationship between force and acceleration is $F(t)=m_{ch}a(t)$ where $F(t)$ is the time varying force vector, $m_{ch}$ is the known mass of the club head and $a(t)$ is the time varying acceleration vector experienced by a given acceleration force sensor. The three dimensional axial domain of the acceleration force vectors has its origin at the center of gravity and the axial domain is orientated with one axis referenced normal to the club head face and another axis aligned with a known angle offset to anticipated non flexed shaft. The mechanism used to measure this category of motional forces is a three dimensional g-force acceleration sensor or sensors.

The second category of force measurements includes the impact pressure forces that occur across the golf club head face for the duration of time for clubface and ball impact. This time varying pressure force is a scalar pressure profile normal to the clubface that is a result of the impact force and location of the ball on the clubface. The relationship between pressure and force is $p(t)=F_{normal\text{-}to\text{-}A}(t)\,A$ where $p(t)$ is the time varying pressure experienced by a given pressure force sensor, $F_{normal\text{-}to\text{-}A}(t)$ is the time varying vector component of the force vector that is normal to the surface of the pressure force sensor and also the clubface, and A is the surface area of a given pressure force sensor element. The axial reference domain is the same for the g-force sensors described above with respect to club face. The mechanism to measure this category of pressure forces is an array of one or more pressure force sensors embedded in the club face that are measuring time varying impact pressure forces across the club face during the entire duration of club head face and ball impact.

Both categories of dynamic direct vector measurements are related with a single time line and a single shared physical domain allowing a large number highly accurate golf club swing, club/ball impact and club head to ball orientation metrics to be realized. To achieve this aggregate of direct physical measurements, the golf club head has embedded within it at least one acceleration three dimensional g-force sensor and at least one, but preferably a plurality of impact pressure force sensors geometrically distributed in the club head face. From the aggregate related measurements of these two measurement categories associated with a single time line and a defined spatial relationship to each other and to the club head physical structure, the following metrics are either directly measured or directly calculated (If a metric calculation requires an assumption, such as ball surface condition and hence friction coefficient, it is stated as an estimate):

1. Time varying pressure or force profile across the golf clubface;
2. Location of impact of clubface and ball on clubface;
3. Duration in time of club head face and ball impact;
4. Maximum pressure or force measured on clubface;
5. Total energy transferred from club to ball;
6. Time varying three dimensional motional acceleration and associated force vectors on club head before, during and after club head face and ball impact;
7. Radial acceleration forces on club for estimation of club head velocity;
8. Three dimensional deceleration force vectors of club head during the club/ball impact;
9. Force vector components that are transferred to ball launch and ball spin;
10. Estimated percent of total energy components transferred to ball trajectory and ball spin;
11. Club head orientation with respect to ball from before club head/ball impact, during ball impact and after impact;
12. Orientation of ball spin referenced to club head face;
13. Estimation of ball launch velocity;
14. Estimation of ball spin velocity;
15. Impact error offset on clubface which is a distance from actual impact location to optimum impact location
16. Club head orientation percentage error from optimum in relation to club head/ball impact (This could be described as an error for each of three vectors describing forces on club head from ball) and;
17. Measure of torque and angular momentum of the club head as caused by the event of club head/ball impact.

The sensors are connected to electrical analog and digital circuitry and an energy storage/supply device 26, also embedded within the club head shell cavity. Further the analog and digital circuitry also referred to as electronics is electrically connected to an antenna system that uses the club head shell as an electrical conductive element as part of the antenna system. The analog and digital circuitry electronic assembly conditions the signals from the sensors, samples the signals from each sensor group category, converts to a digital format, attaches a time stamp to each category or group type of simultaneous sensor measurements, and then stores the data in memory. The process of sampling sensors simultaneously for each sensor category or group type is sequentially repeated at a fast rate and may be a different rate between sensor categories or group types, so that all measured points from each sensor category or group type are relatively smooth with respect to time. The minimum sampling rate is the "Nyquist rate" of the highest significant and pertinent frequency domain component for each of the sensors' category or group types time wave representations.

The electronics assembly, further temporarily stores the measured data sets and further formats the data into protocol structures for wireless transmission. Each data set is queued and then transmitted in a wireless protocol format from a radio frequency transceiver circuit that is electrically connected to an antenna system assembly electrical port. The antenna system comprises at least two electrically conducting elements. One of the electrically conducting elements of the antenna system assembly is the electrically conductive club head shell. The shapes and sizes of all antenna elements and objects are optimized as an antenna system to provide a desired input electrical port impedance characteristic and a desired radio wave radiation pattern for the antenna system. Further the electrically conductive club head element and club face assembly also provides the physical structure and performance attributes of a functional golf club head.

The combined weight of all assemblies of the integrated electronics system golf club head is substantially equal to that of a regulation play club head of similar type. In addition, the mounting location of all pieces of all assemblies either internal to the club head shell or external to the club head shell are configured so the center of gravity of the integrated electronics system golf club head is substantially similar to that of regulation play golf club head of similar type that is considered to deliver good performance This invention also provides a variety of methods including the sequence of steps that may be used to effectively optimize all of the variable that are encountered with the design of integrated electronic system golf club head, taking into account the many tradeoffs between dual function requirements placed on individual components and structures.

The present invention encompasses a variety of options for the golfer to receive and interpret the information of swing, impact and orientation metrics or a subset of total metrics available. The human interface function is separate human interface device that communicates wirelessly with the integrated electronic system golf club head. The human interface function can provide all or any subset of audible and visual outputs. Examples may include wireless smart device such as a PDA or laptop computer or any other device that has processing capabilities and a display and audio capabilities and can be adapted to communicate wirelessly using standard or non-standard wireless protocols. Some of the standard wireless protocols may include but not limited to ZigBee, Blue-Tooth or WiFi. Some of the non-standard protocol may include a completely custom modulation with associated custom protocol data structure or standard high level packet structure based on 802.11 or 802.15 with custom sub-packet data structure within high level packet structure.

The preferred embodiment of the integrated golf club, in addition to the previous described electronics, also has data formatting for wireless transport using Bluetooth™ transceiver protocols. The data, once transferred over the wireless link to the laptop computer, are processed and formatted into visual and or audio content with a proprietary software program specific for this invention. Examples of user selectable information formats and content could be:

1. a dialog window showing a graphical representation of the clubface using a color force representation of the maximum force gradient achieved conveying the area of impact of the ball and along the side the graphic could show text describing key metrics such as maximum force achieved, radial acceleration of club at impact (related to club head velocity) and total energy transferred to the ball;
2. a motion video of the time varying nature of the forces on the clubface;
3. a three dimensional graphic showing force vectors on club head from ball;
4. an audio response which verbally speaks to the golfer telling him/her the desired metrics;
5. a video showing time varying acceleration vectors of the golf club head during the swing and through impact; or
6. numerous other combinations of audio and visual user defined.

BRIEF DESCRIPTION OF THE DRAWINGS

The above and other features of the present invention will become more apparent upon reading the following detailed description in conjunction with the accompanying drawings, in which.

DETAILED DESCRIPTION

The present invention comprises an integrated golf club that further comprises a golf club shaft with a grip attached at one end and an integrated electronic system golf club head attached at the other end. The integrated electronic system golf club head measures directly and stores time varying acceleration forces during the entire golf club swing and further additional time varying impact forces in the time span from before the golf club head and ball impact, to a point in time after club head and ball separation. There are two categories of physical parameters being measured in real time with different mechanisms; both convert directly to time varying force vectors. The force vectors from each measurement mechanism are interdependent in time and in a fixed spatial relation to one another as the club head transitions through all of the different dynamic forces during a golf swing, ball impact and after impact.

Figure 1:
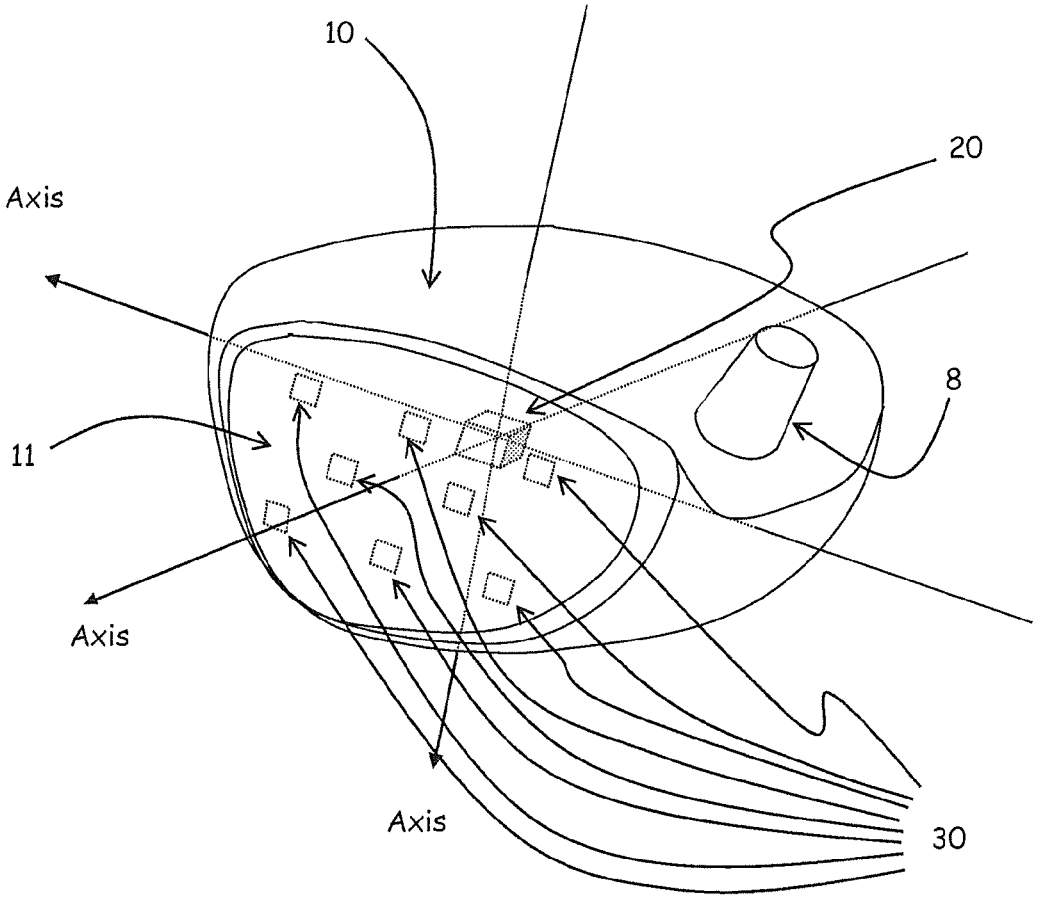
FIG. 1 is a perspective view of the present invention integrated golf club head (golf club shaft not shown) with impact pressure force sensors embedded in the clubface and a three dimensional g-force acceleration sensor inside the club head.

As shown in FIG. 1, the golf club head 10, has a three dimensional g-force acceleration sensor 20 mounted within the electrically conductive club head 10 shell cavity at a predetermined location. In one of many embodiments for this invention, the sensor(s) can be placed at a predetermined location that is the center of gravity of the club head 10 for simplification of metric calculations. However, the sensor(s) does not have to be located at the center of gravity and all metrics defined are still achievable. The club head 10, also has an array of impact pressure force sensors 30 embedded in the golf club head face 11. The hosel 8 may be made of a material that electrically conductive or electrically non-conductive depending on embodiment implementation and is attached to the club head 10. The hosel may be adapted to connect and disconnect from a golf club shaft (not shown) of the club.

Figure 2:
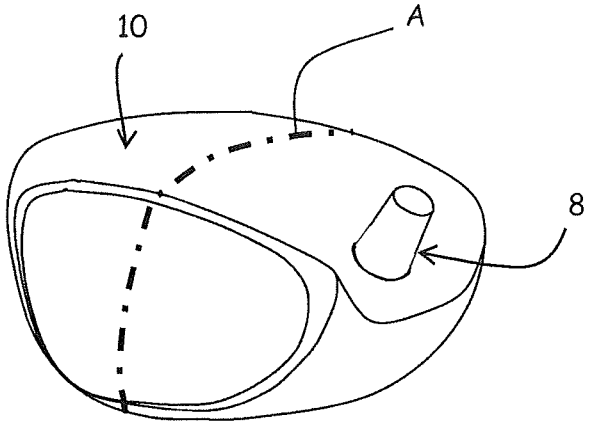
FIG. 2 is a perspective view of the present invention as shown in FIG. 1 except showing dashed line A and without depiction of the sensors.
Figure 2A:
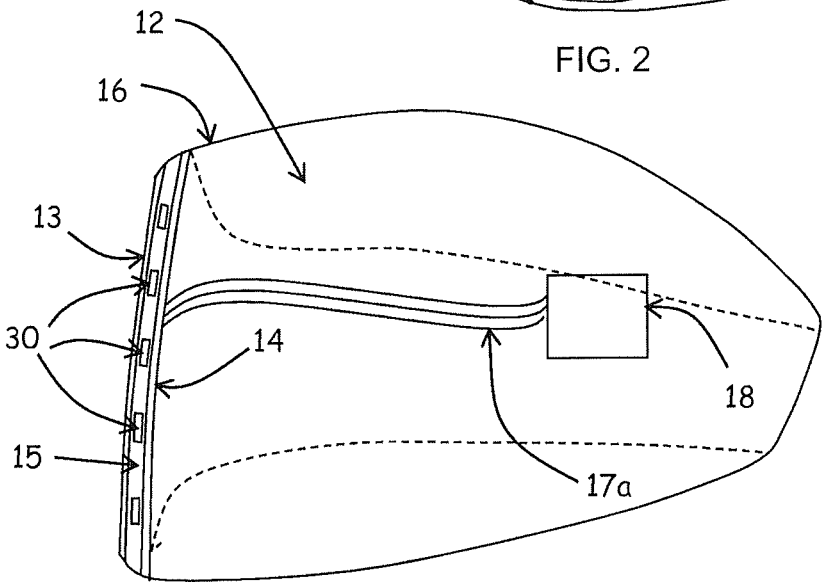
FIG. 2A is a cross sectional view of the club head of the present invention of FIG. 2 taken along line A showing clubface structure with two metal layers and there between the impact pressure force sensor elements within embedding material monolith and further sensor elements electrical connected to electronics module within club head shell
Figure 2B:
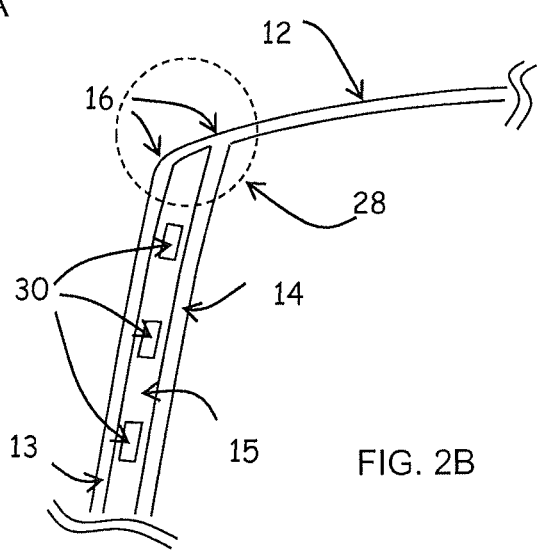
FIG. 2B is a partially exploded cross sectional view of the club head face assembly of the present invention showing two metal layers both rigidly attached the club head shell housing.

As shown in FIGS. 2, 2A and 2B the club head 10 and a club head cross section view FIG. 2A and FIG. 2B show selected assemblies. FIG. 2A show cross sectional view 12 of club head 10 showing the construction of the club face 11 assembly having two metal layers, the outer layer 13 and the inner layer 14. The outer and inner layers 13, 14 are made with predetermined materials that may be the same or different. In the preferred embodiment both layer 13 and layer 14 are both made of a metal type material. The pressure force sensors 30 are imbedded in a non-metallic, non-electrical conducting medium of optimum physical properties 15 between the two layers 13 and 14 as part of the clubface 11. The non-conducting medium 15 is a hard epoxy or similar material monolith structure with the pressure sensors 30 and their electrical connections embedded within it. Some examples of possible materials include UV curable epoxies such as UV Cure 60-71 05™ or medium to hard composition of Vantico™ or one of the compositions of Araldite™ or other suitable materials. The monolith structure can be created with exact pressure sensor placement and orientation with known injection molding technologies. An example of this process would be to make an injection mold that creates half of the monolith structure and has half pockets for a precise fit for each of the sensors and electrical connection ribbon. The sensors 30 with electrical connections are then placed in the preformed pockets of the initial half monolith. The initial half monolith with sensors is then placed in a second injection mold which completes the entire monolith. The sensors 30 are attached to a flex circuit ribbon 17*a* that will extend out from the monolith structure, through a small pass through opening in the inner layer 14, that connects to the electronics assembly 18 in the club head cavity.

The non-conducting monolith material 15 with embedded pressure sensors 30 can be pressure fit between the outer layer 13 and the inner layer 14. The outer layer 13 and the inner layer 14 can be connected to the club head shell housing 16 with conventional club head construction techniques utilizing weld seams or other attachment processes. Some techniques might include Aluminum MIG (Metal Inert Gas) welding for aluminum to aluminum connection and brazing for aluminum to titanium connections.

The clubface layers 13 and 14 can be titanium or comparable metal or alloy and the club head housing components can be an aluminum or alloy.

As shown in FIG. 2B, another cross sectional expanded view which is the preferred embodiment of the present invention, the inner metal layer 14 is a predetermined thickness and shape with a defined rigidness the outer clubface layer 13 is a predefined thickness and shape with a defined rigidness that define a club face system when combined with monolith 15. Both the outer layer 13 and the inner layer 14 are rigidly attached to the club shell housing 16 through the aforementioned welding process. In this configuration, the pressure exerted and resulting deformation on the outer layer 13 of golf clubface 11 resulting from ball and club face impact create a time varying pressure profile on the non-metallic medium monolith 15. The individual pressure sensors 30 each generate an output voltage proportional to the pressure experienced by that sensor. The pressure force sensors each may be any predetermined size and shape individually. However, the pressure sensors elements 30 in the preferred embodiment are piezoelectric elements made of a predetermined material with the same predetermined shape, surface area and thickness, therefore generating identical pressure force versus voltage profiles. In the case where the clubface inner 14 and outer 13 metal layers are both rigidly connected to the club head shell housing 16, the deformation of the monolith 15 will be less near the edge 28 of the clubface. This means that less pressure will be measured for the same impact force by sensors closer to the edge of the club face 11. These variations will be a constant with respect to the fixed geometric shape of club face system in combination with club head 10 shell and can be calibrated out in the digital signal process with fixed calibration coefficients programmed into the processing. Calibration coefficients may be determined through simulation or during production on a per club head type basis.

The predetermined materials used and predetermined shapes and thicknesses of all components of the club face structure assembly are individually optimized to further optimize the physical properties of the overall club face system to be substantially similar to that of a regulation play golf club head face of similar type and to provide adequate sensitivity of sensor embedded 30 in monolith structure 15. The process for design optimization of the club face system assembly defines the material properties used for each individual piece of the club face assembly and also the physical structure including size and shape of each individual piece of the club face assembly. Further the defined materials, shapes and sizes of all pieces further defines the club head face system overall weight and form factor and mass distribution. The process for design optimization of the club face system is a sub process of the overall design optimization process of the integrated electronics system golf club head.

The process for design optimizing the club face system takes into account several considerations and tradeoffs. The primary two objectives are to define a club face system structure that physically performs like a regulation club face of similar type and also provides adequate sensor sensitivity across the club face to measure with reasonable resolution ball/club face impact relative to a reasonable dynamic range of club head speeds at impact. An example dynamic range for a driver type may be 45 MPH to 130 MPH. Secondary goals are to achieve the lowest weight possible for the club face system providing maximum flexibility for the final optimization process that defines final weight and mass distribution of integrated electronics system golf club head design. Therefore a means of defining the optimal predetermined materials, sizes and shapes for all components of the club face assembly are done with the design optimization process for the club face system include the steps of:

1. Choose club head type
2. Choose a typical club head speed dynamic range for that golf club type in association with targeted golfer population skill level.
3. Choose a piezoelectric material that will provide high electromechanical coupling coefficient for sensor element(s) 30 for electronic measurement resolution purposes.
4. Choose metal material for outer club face layer 13
5. Choose material for inner club face layer 14
6. Choose attachment mechanism for club face assembly attachment to club head shell.
7. Choose material for monolith for embedding sensor elements 30 and define an initial size and shape of impact sensor elements based on knowledge monolith material.
8. Start with initial thickness and shape factor of outer club face layer 13 similar to that of a regulation club of that type.
9. Choose an initial thickness shape factor for inner club face layer 14 that is substantially thinner and has similar shape factor of initial outer club face layer 13
10. Choose an initial thickness of monolith that is 1.5-2 times the thickness of the sensor elements based on piezoelectric material selection in step 3.
11. Model with a Finite Element Simulator that has piezoelectric modeling capabilities such as PZ-Flex™ the layered structure comprising, outer layer 13, monolith 15 and inner layer 14, with all edges bound in accordance with step 6.
12. Through simulation, record voltage waveforms for all sensor elements for time varying loads applied to outer surface of outer layer 13 representing a golf ball impact of a predetermined speed and predetermined location on club face.
13. Repeat step 11 for different impact speeds from lowest to highest defined by the step 2 dynamic range for a specific location on the club face.
14. Repeat step 12 for different impact location on club face.
15. Evaluate elastic response characteristics of club face system compared to a regulation club face of similar club type in relation to COR (Coefficient of Restitution).
16. Evaluate electrical response of sensor outputs based on maximum amplitude measure at maximum club head velocity with impact at the center of the club face.
17. Evaluate electrical response of a sensor with maximum output at minimum velocity for a ball impact near a bound edge.
18. Define dynamic range regarding electrical sensor out from step 16 defining high end of dynamic range across club face and from step 17 for low end of dynamic range across club face.
19. Evaluate if electrical dynamic range of sensor outputs for entire club face (from step 18) provides adequate sensitivity for defined data capture constraints of electronics assembly.

20. Evaluate elastic response characteristics of club face system (from step 15) are within a defined tolerance when compared to a regulation golf club face of similar type.
21. If steps 19 and 20 are satisfied, optimization is complete. If one or both criteria are not satisfied adjust control parameters that include thickness of metal layers 13 and 14 and monolith layer 15 in the flowing manner:
    a. If electrical dynamic range is too small to provide adequate sensitivity do any single or combination of the following:
        i. Increase metal layer thickness 14
        ii. Decrease metal layer thickness 13
        iii. Decrease monolith layer 15
    b. If electrical dynamic range is larger than require for adequate sensitivity do any single or combination of the following:
        i. Do nothing and move to strait to elastic response adjustments if needed—and reduce sensor signal levels uniformly in electronics assembly before data capture
        ii. Increase metal layer thickness 13
        iii. Decrease metal layer thickness 14
        iv. Increase monolith layer 15
    c. If elastic response of club face system is to stiff do any single or combination of the following:
        i. Decrease metal layer thickness 13
        ii. Increase monolith layer thickness 15
        iii. Decrease metal layer thickness 14
    d. If electric response is too soft, do any single combination of the following:
        i. Increase metal layer thickness 13
        ii. Decrease monolith layer thickness 15
        iii. Increase metal layer thickness 14
22. Select control parameters to adjust electrical and mechanical responses and feed new control parameters based on step 21 a, b, c, d into step 11 and repeat process until club face system performance criteria are met.

Figure 3:
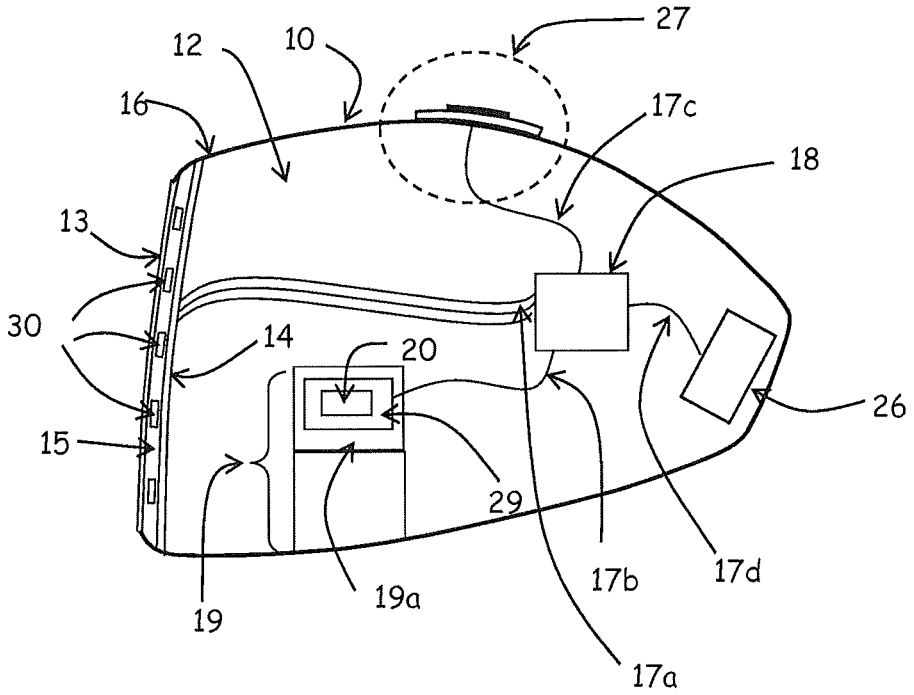
FIG. 3 is a cross sectional view of the club head system showing the clubface assembly, antenna assembly, three dimensional acceleration measurement assembly, electronics assembly and energy storage assembly with electrical connections between said assemblies.

FIG. 3 shows a cross section view of the integrated electronics system golf club head with assemblies related to measurement and commination's represented. The three orthogonal axes acceleration measurement assembly comprises a three dimensional acceleration g-force sensor 20 or combination of one and two dimensional g-force sensors to give three dimensional measurement capabilities that are attached to a small printed circuit board 29. The printed circuit board 29 is electrically connected with electronics assembly 18 with a flex ribbon 17*b*. The acceleration measurement assembly is mounted in a predetermined spatial relationship to the club head shell structure. The preferred embodiment defines the predetermined spatial relationship to the club head shell structure to be the center of gravity of the overall integrated electronics system golf club head. The mounting method and structure of mounting mechanism is defined latter in the final design optimization process. An example of a resultant possible mounting from final design optimization process is described for clarity purposes. In one embodiment the small printed circuit board 29 will be attached with a durable adhesive to a metallic or non-metallic rigid protrusion 19 attached to the club head 10 shell inner surface either by adhesive, weld, fastener, or other well-known connection means. The protrusion 19 extending to the spatial location that is predefined location for the sensor circuit board 29 assembly. The surface areas 19*a* of the protrusion 19 on which the sensor's printed circuit board 29 is mounted has a defined orientation within the club head to align the acceleration measurement axes with the pre-defined reference axes of the club head.

The electronics assembly 18 is located at a predetermined location within club head shell 10 cavity. The predetermined location and mounting method are defined later in the final design and optimization process. The electronics assembly 18 is electrically connected with flexible transmission line or coax cable 17*c* to antenna elements and object(s) assembly 27 and located at a predetermined location on club head 10 shell outer surface. Further electronics assembly 18 is electrically connected with wire(s) 17*d* to energy source assembly 26 that is located at a predetermined location within club head 10 shell. All assemblies located in the club head 10 shell cavity may be mounted in their individual predefined locations with mounting structures attached to club head 10 shell cavity inner surface similar to structure 19 or may be held in their predetermined location within a light weight molded form body that that is spatially fixed in club head 10 shell cavity and provides spatial support for each assembly relative to club head 10 shell structure. The light weight molded form body may be a durable light weight foam material or a light weight plastic molded structure.

All of the assemblies including: club face assembly, electronics, acceleration g-force sensors assembly, antenna system assembly and energy source assembly each have a predetermined weight that is defined in the design optimization process of each separate assembly. The assemblies are combined and assembled in the final design optimization process where final individual predetermined location of assemblies and club head shell wall thickness profiles are defined to further define the desired weight and mass distribution of overall club head system. optimized club head shell structure that is part of the antenna system assembly have a total weight substantially similar to that of a regulation golf club head of similar type that is recognized to have good performance. In addition, the predetermined locations of the antenna components sub-assembly(ies) and electronics assembly and the acceleration g-force sensor assembly and the energy source assembly in conjunction with club face assembly are optimized so that the center of gravity of the integrated electrons system golf club head is substantially similar to that of a regulation golf club head of similar type.

In general, mobile electronic devices that depend on a battery or other energy storage device(s) and that utilize radio wave wireless communications are challenged with size, weight and operational time duration. The power consumption efficiency of an electronics wireless system is heavily depend the ability to efficiently convert electronic signals generated from within the physical electronics to propagating radio waves with an intended radiation pattern. The power efficiency of the conversion process is typically dominated by the characteristics of the physical antenna elements structures that further control the electrical port impedance of the antenna system operating at a predetermined frequency or frequency band.

The integrated electronics system golf club head antenna system utilizes the electrical properties and defines physical surface shape properties of the club head shell itself as part of the antenna system. The components of the antenna system include at least two or more electrically conducting elements and may include at least one or more electrically non-conducting objects. The preferred embodiment antenna system of this invention utilizes and defines the club head shell and surface structure as one of the electrically conducting elements. The design optimization process for the antenna system defines the shape(s), size(s), and material properties of all components of the antenna system. All components of the antenna system are also in a predetermined fixed spatial relationship with one another. The design optimization process of the antenna system defines all components of the antenna system and specifically defines a club head shell outer surface structure that in combination with other antenna components provides desired radiation patterns and desired electrical input port impedance to optimize the power efficiency of the system that further enables a smaller and lighter energy storage device. In addition, the wall thickness of the club head 10 shell are further optimized in later described processes to provide structural support for the overall assembled club head to perform as a golf club head with substantially similar physical performance criteria as a regulation golf club head of similar type.

The integrated club head antenna system may be implemented with one or a combination of techniques that launch radio wave and influence radiation patterns. The first technique employs the club head as a quasi-ground plane or ground object reflector that is in a fixed spatial relationship with other electrically conducting element or elements. The radiating element such as a wire operating in the presence of a ground object produces two rays at each observation angle, a direct ray from the radiating element and a second ray due to the refection from the ground object affecting radiation pattern. The second technique employs patch antenna theory that requires a ground plane or quasi ground plane that in combination with a conductive patch or sheet type electrically conductive element creates a trapped wave resonant cavity. The resonant structure facilitates electric field fringe effects to generate electromagnetic radiating apertures. The required quasi ground plane or quasi-ground object is implemented with the conductive club head shell surface. In both techniques, the club head shell is used as an electrically conductive element of the antenna system and the structure of the electrically conductive club head shell outer surface is an integral part of the overall antenna system design and affects performance with regards to electrical port impedance and the radiation pattern and reception gain performance of the antenna system structure as a whole.

The preferred embodiment of the antenna system comprise at least, a first electrically conducting element that is a golf club head shell made of electrically conducting material and at least one additional electrically conducting element and may have at least one electrically non-conducting object.

Figure 4:
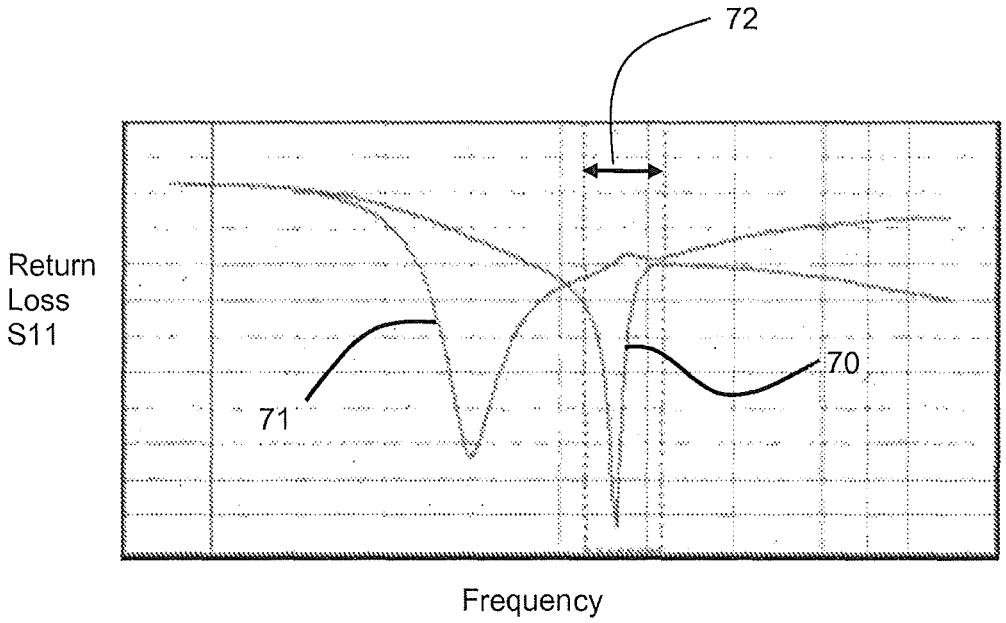
FIG. 4 is a graph showing two return loss measurements (S11) of a single antenna, demonstrating the detuning effect on electrical port impedance when antenna is placed near an electrical conducting object.

The benefits of the integrated club head antenna system are multifaceted, namely fewer parts, lighter weight and better performance as compared to using an off the shelf antenna(s) that is/are not designed to function in the constant presence of a metal object namely the club head. For an off the shelf generic antenna designed for a free space environment, both port impedance and radiation pattern are also strongly influenced by all electrically conducting objects in their near environment. The result of using an off the shelf antenna in the near presence to a golf club head has the effect of detuning the electrical port impedance creating an impedance mismatch between the circuitry electrical output port that is driving the electrical input port of the antenna system. As shown in FIG. 4, an electrical port impedance change of an antenna system is demonstrated with two different return loss (S11) measurements on a network analyzer. The first S11 curve 70 shows an antenna return loss with the intended impedance match between the 50 ohm network analyzer port and the intended 50 ohm impedance of the electrical port of the antenna for the intended frequency band 72 in a relatively free space environment. The second S11 curve 71 is measured with the antenna system in the presence of a large metal object in near proximity of the same antenna. The S11 curve 71 shows the significant impedance mismatch described with return loss that is now taking place in the intended frequency band 72 between the 50 ohm port of the network analyzer and the antenna system port. In summary, the presence of a metal object near an antenna system significantly alters the input impedance of the electrical port of the antenna and alters the overall radiation pattern of the combination or antenna and reflecting object.

All of the variations of the antenna system comprise at least, a first electrically conducting element that is a golf club head shell made of electrically conducting material and at least one additional electrically conducting element and may have at least one electrically non-conducting object.

Figure 5:
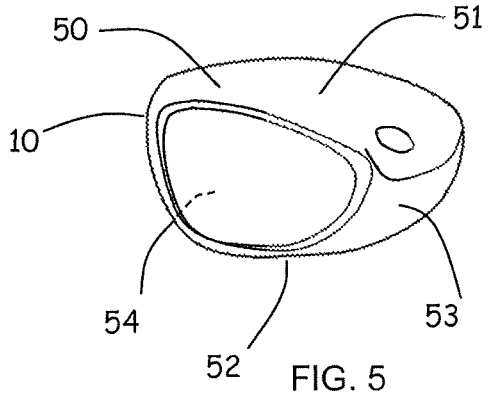
FIGS. 5, 5A, and 5B show components of the antenna assembly that include FIG. S the club head shell with electrically conductive outer surface, FIG. 5A example types of some possible additional conductive elements and FIG. 5B example types of some possible electrically non-conductive objects.

As shown in FIG. 5 the first conducting element of the antenna system is the electrically conductive club head 10 shell that has an outer surface 50 with club face assembly included. The outer conductive surface 50 comprises regional surfaces that include the top surface 51 and bottom surface 52 and side surfaces that include a toe side surface 54 and heal side surface 53. The shape and contour of one or more of the outer surface components may be modified to optimize the antenna system performance.

Figure 5A:
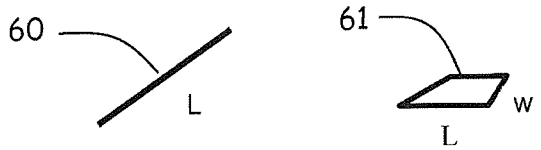

As shown in FIG. 5A the second or other or additional electrical conducting element(s) of the antenna system can be any predefined shape(s). Some examples additional electrical conducting elements are a wire 60 of a predefined length L and predefined form factor or a metal sheet in a plane 61 form factor or domed shape (not shown) form factor or any other surface form factor of predefined descriptive dimension such as length and width and other dimensions describing shape or a combination thereof.

Figure 5B:
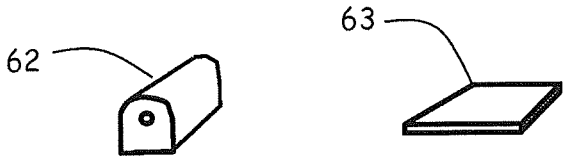

As shown in FIG. 5B a least one or more electrically non-conducting object(s) may each be any predefined shape and size with a predefined dielectric property. The predefined shape(s) and the predefined dielectric properties are defined in the design optimization process for the antenna system. The function of the electrical non-conducting object is to physical hold the additional electrical conducting elements in a predetermined orientation to a predefined surface structure of the electrically conductive club head shell outer surface and affect the electric field in a predetermined way of the additional electrically conducting element. An exemplary electrically non-conducting object 62 may be a shape that is adapted to attach to a some predetermined location on the club head shell outer surface 50 and further supports the an additional electrically conducting element such as wire 60 at a predetermined spatial relationship to the club head shell and electrically non-conducting object 62 has the material dielectric property similar to air. Another exemplary electrically non-conducting object 63 is a sheet of material that may be a plane type shape with a predetermined length, width and thickness and further a predetermined dielectric constant that is substantially higher than that of air and that attaches to the club head shell 10 outer surface 50 at a predetermined location and is further attached to the metal plane 61 with metal plane 61 located at a predefined location on the surface of electrically non-conducting object 63.

Figure 6:
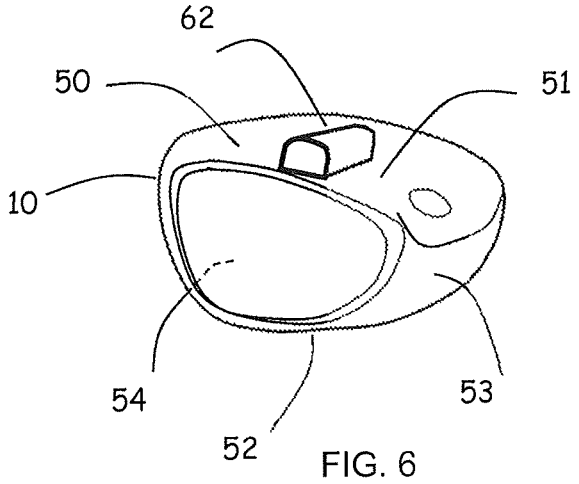
FIG. 6 shows an embodiment of an antenna system with a first electrically conducting element that is the club head shell outer surface attached to an electrically non-conducting object that is further attach to and enclosing to a second electrically conducting element of a wire type.
Figure 6A:
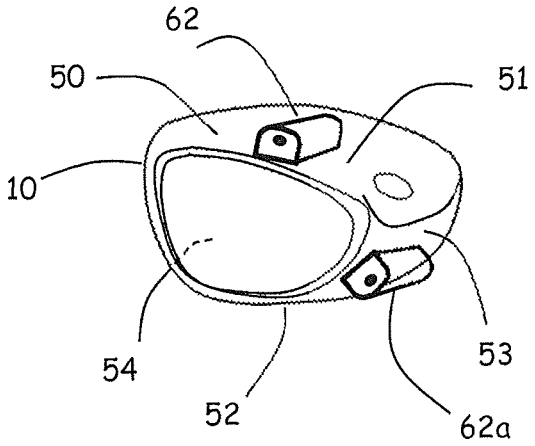
FIG. 6A shows another embodiment of an antenna system with a first electrically conducting element that is the club head shell outer surface attached to two separate electrically non-conducting objects that each further attach individually and enclosing to two separate electrically conducting elements, both of a wire type.

FIG. 6 and FIG. 6A show antenna systems that utilize the conducting club head 10 shell as ground reflector for an antenna system. FIG. 6 shows an exemplary antenna system configurations comprises a club head 10 shell outer surface 50 that is connected to an electrically non-conducting object 62 in a predefined location on club head 10 shell outer surface 50, that further attaches to and supports a second electrically conductive element (not shown, but within non conducting object 62) that is held in a predetermined spatial relationship to club head 10 shell outer surface 50. The electrical port of antenna system is defined by two electrical connections points (not shown), the first electrical connection point is on the interior surface of the electrically conductive club head 10 shell and the second connection point is a location on the second or additional electrically conducting element (not shown, but within non conducting object 62) that is feed through an insulating pass through (not shown) of the club head 10 shell. The club head shell surface structure and all predetermine or predefined dimension and locations and spatial relationships of all electrically conducting elements and electrically non conducting object are defined to optimize the antenna system electrical port impedance characteristics for a predefined frequency band and the antenna system radiation pattern for desired characteristics.

As shown in FIG. 6A another exemplary antenna system configuration comprises the club head 10 shell with two separate electrically non-conducting object 62 and 62*a*, each with an individual predetermined size and shape factors and each attached at a separate predetermine location on club head 10 shell outer surface 50. Further each electrically non-conducting object further supports separate additional electrically conducting elements (element not show but each within respective electrically non-conducting objects) each with an individual predetermined fixed spatial relationship to club head 10 shell outer surface 50. The electrical port of the antenna system is defined by two electrical connection points. The first connection point is on the interior surface of the electrically conductive club head 10 shell and the second electrical connection point is a single point that is electrically connected both second and third electrically conducting additional elements (not shown, but within respective electrically non-conducting objects 61 and 62*a*). Further each individual electrically conducting additional element is fed through an individual insulating pass through in the club head 10 shell and the electrical connections between the two additional electrically conducting elements is made in the interior cavity of the club head shell (not shown) defining the second electrical connection point of the antenna system electrical port. The club head shell surface structure and all predetermine dimension and locations of all electrically conducting elements and electrically non conducting objects are defined to optimize the antenna system electrical port impedance characteristics for a predefined frequency band and the antenna system radiation pattern for desired characteristics.

Figure 7B:
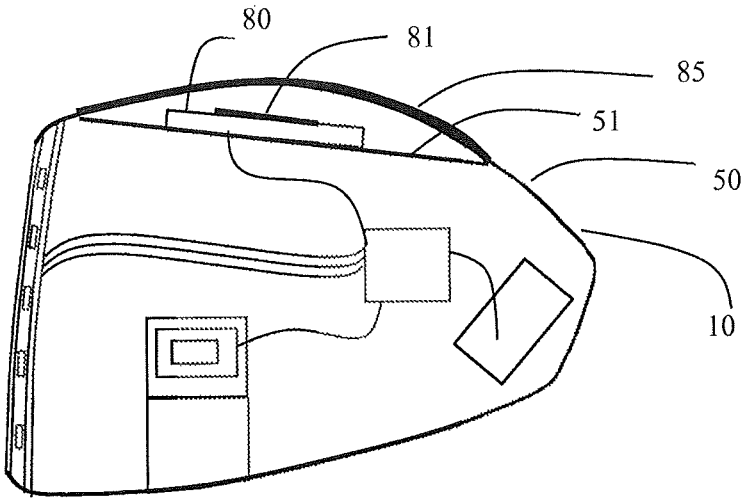
FIG. 7B is a cross-sectional view of club head utilizing the antenna system of FIG. 7 showing another electrically non-conducting RF transparent structure attached to club head shell outer surface and covering antennas system components for improved aerodynamic performance.
Figure 7A:
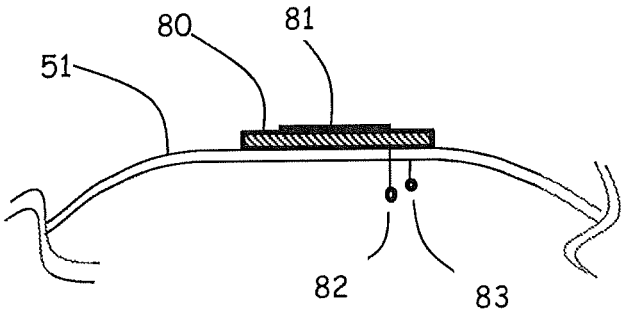
FIG. 7A is a partially exploded cross sectional view of the antenna system of FIG. 7 showing the two electrical contact points that define the antenna system electrical port.
Figure 7:
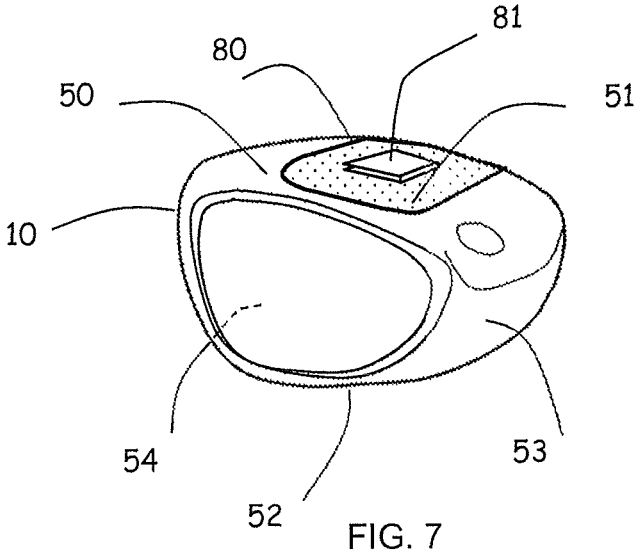
FIG. 7 shows the preferred embodiment of an antenna system configured to utilize fringe e-field effects to create radiating apertures similar to patch type antennas. The antenna system comprises a first electrically conducting element that is the club head shell outer surface that attached to a first electrically non-conducting object that is a dielectric sheet that is further attached to a second electrically conducting element that is a metal sheet.

As shown in FIG. 7 and FIG. 7A another embodiment of the antenna system is based on a patch antenna structure. As shown in FIG. 7 an exemplary antenna system comprises a first electrically conducting element that is the club head 10 shell that has a top surface 51 that is adapted to be flat in a given surface area. An electrically non-conducting object 80 is attached to the top surface 51 at a predetermined location and orientation to top surface 51. Further electrically non-conducting object 80 has a predetermined size and shape and material properties and in this example the object 80 is a material with a predetermined dielectric property value. Further electrically non-conducting object 80 has attached to it at a predetermined location, an additional electrically conducting element 81 with a predetermined size and shape. As shown in FIG. 7A a cross sectional expanded view of this example antenna system shows the club head 10 shell top surface 51 attached to electrically non-conducting object 80 further attached to the additional electrically conducting element 81. Further FIG. 7A shows the antenna system electrical port connection points 82 and 83. The electrical port connection point 82 is electrically connected with wire or transmission line that passes through an electrically insulated pass-through in club head 10 shell wall and another pass-through in non-conducting object 80 to additional electrically conducting element 81 where wire or transmission line is electrically connected to additional electrically conducting element 81. The electrical port connection point 83 is electrically connected to electrically conductive club head 10 shell directly or with short wire. The club head 10 shell outer surface 50 structure and all predetermine dimension, shapes and locations of all electrically conducting elements and electrically non-conducting objects are defined to optimize the antenna system electrical port impedance for desired characteristics for a predefined frequency band and the antenna system radiation pattern for desired characteristics.

Another antenna system example comprises a first conducting element that is the electrically conducting club head 10 shell, and at least two more additional electrically conducting elements comprising at least one that is adapted for patched type structure(s) and at least one adapted for a wire type structure(s) of individual predetermined size and shape. Further the antenna system may have electrically non-conducting objects of predetermined size and shape associated with each of the additional conducting elements. The club head shell 10 outer surface 50 structure and all predetermine dimension, shapes and locations of all additional electrically conducting elements and electrically non-conducting objects are defined to optimize the antenna system electrical port impedance for desired characteristics for a predefined frequency band and the antenna system radiation pattern for desired characteristics.

Another embodiment antenna system has more than one electrical port where each port has two electrical contact points. This antenna system comprises at least three electrically conducting elements and first electrically conducting element is the golf club head 10 shell and at least two addition electrically conducting elements. The first electrical port comprises two electrical contact points and first electrical contact point is electrically connected the first electrically conducting element club head and second electrical contact point is connected to one or more additional conducting element(s) but not all additional conducting elements. The second or additional electrical ports(s) each have two electrical contact points and the first electrical contact point is electrically connected to the first electrically conducting element the club head and the second electrical contact point is electrical connected to at least one additional electrically conducting element that is not electrically connected to the electrical contact point of first port or other additional port(s). The benefit of an integrated electronics system golf club head with multiple antenna ports is the system can then support full duplex operation with constant receive and transmit taking place simultaneously on two different frequencies or two different frequency bands. In addition an antenna system with multiple ports could support MIMO (Multiple Input Multiple Output) wireless communication structures supporting much higher communication data rates.

All attachments required between electrically conducting elements and electrically non-conductive objects may be accomplished with an electrical conductive or non-conductive adhesive or fasteners.

All of the antenna system embodiments may have additional electrical non-conducting structures that attached to the club head 10 shell external surface that further cover antenna system components to provide a smooth surface of overall club head structure to provide a similar aerodynamic structure to that of a similar golf club head type. The material properties of the aerodynamic enhancement structures include radio frequency transparency with regards to radio wave signals. In other words do not affect radio waves as radio waves pass through the aerodynamic enhancement structures.

FIG. 7B shows a cross sectional view example of club head 10 with a patch configuration antenna system assembly embodiment with an aerodynamic enhancement structure 85. Aerodynamic enhancement structure 85 attaches to club head 10 shell outer surface 50 covering modified top surface area 51 and electrically conducting element 81 and electrically non-conducting object 80. Aerodynamic enhancement structure 85 may be attached to club head 10 outer surface 50 with a non-conducting adhesive or fastener. The benefit of the aerodynamic enhancement structure is that it allows greater manipulation of the club head 10 shell outer surface 50 structure for more flexibility in antenna system design, while providing the aerodynamic properties of club head overall outer surface structure to be substantially similar to that of a high performance club head of similar type.

As previously recited, the antenna system has numerous control variables that affect the electrical performance of the total electronics system and the structural physical performance of the club head. To define the predetermined values for all of the control variables in the antenna system to meet electrical and physical requirements, a design optimization process is used. A means of antenna system design optimization comprises a process with the steps of:

1. Define the club head type for the system.
2. Define the frequency band of operation for the antenna system
3. Define the desired radiation pattern of the antenna system
4. Define the antenna system desired electrical port impedance characteristic based the predefined electronics drive port electrical impedance characteristic in regards to the predefined frequency band of operation.
5. Define an estimated number of additional electrically conducting elements and what club head surface areas will be utilized for desired radiation pattern coverage around club head.
6. If any of the additional electrically conductive elements are intended for patch structures define an estimate of the property of dielectric constant for the electrically non-conducting object based on frequency band and general surface area available for selected club head surface area.
7. Calculate through know estimation equations an initial estimates of size, shape and dimensions of addition electrically conducting elements of the wire type, and assume free space environment based on predefined frequency of operation that defines related wavelengths of operation. Standard or non-standard conducting element structures may be used. Typical and standard structures include but are not limited to wire type structures such as short dipole, ¼wave dipole, half wave dipole, helix, L, F etc. Non-standard structures can also be used, however, estimate calculation equations will need to be derived independently based on Maxwell equations.
8. Calculate through know estimation equations based on defined frequency band the initial estimates of size, shape and dimensions of addition electrically conducting element(s) of the patch type and size, shape and dimensions of electrically non-conducting object(s), in conjunction with a predefined dielectric property of the associated electrically non-conducting object(s). Assume an ideal planer ground connected to the electrically non-conducting object and assume free space environment based on predefined frequency of operation that defines related wavelengths. Standard or non-standard conducting element structures may be used. Typical and standard structures include but are not limited to patch or leaky transmission line type structures on an ideal ground planer surface such as layered and multilayered structures with a variety of coupling feed types. These estimates will be a starting point for further considering non-planer structures and a non-ideal ground planes such as the club head shell.
9. Using estimated size and shape and location for club head structure and all additional electrically conducting elements and all electrically non-conducting objects build a model in ANSYS HFSS 3d full wave electromagnetic field solver.
10. For an antenna system that use wire type additional electrically conducting elements only:
    a. Adjust spatial location and orientation of addition electrical conducting elements in relation to club head shell to achieve desired radiation pattern.
    b. Adjust club head shell outer surface area region contours related to each additional electrically conducting elements to further tune radiation pattern.
    c. Adjust size, shape and dimensions of previous estimates (Step 6) of additional electrically conducting elements to achieve a desired input port impedance characteristic in the define frequency band.
    d. Repeat steps 9a through 9b and further adjust end results of step 9c to retune radiation pattern and input port impedance characteristics.
    e. Define electrically non-conducting object structures including size and shape for attachment to defined predetermined club head shell outer surface area structure to further attach additional electrically conductive elements of defined predetermined size and shape in defined predetermined spatial reference to club head shell outer surface area region.
11. For an antenna system that use patch type additional electrically conducting elements only:
    a. Adjust spatial location and orientation addition electrical conducting elements associated fixed relation electrically non-conducting objects in relation to club head shell to achieve desired radiation pattern.
    b. Adjust club head shell outer surface area region contours related to each additional electrically conducting elements to further tune radiation pattern.
    c. Adjust size, shape, and dimensions of previous estimates (Step 7) of additional electrically conducting elements to achieve a desired input port impedance characteristic in the define frequency band.
    d. Repeat steps 10a through 10b and further adjust end results of step 10c to retune radiation pattern and input port impedance characteristics.
12. For an antenna system that utilize both wire type and patch type additional conducting elements:
    a. Conduct steps 9a and 10a
    b. Conduct steps 9b and 10b
    c. Conduct steps 9c and 10c d. Conduct steps 9d and 10d e. Conduct step 9e 13. Evaluate assembled antenna system including all electrically conducting elements and electrically non-conducting based on electrical performance as an antenna with port impedance and radiation pattern performance criteria and physical properties as a golf club head with aerodynamics as a criteria. If aerodynamics of club head outer surface structure not satisfactory implement aerodynamic enhancement structures.

14. Define weight of antenna assembly with all components including aerodynamic enhancement structure (if used). At this point the electrically conducting club head shell has zero wall thickness and therefore zero weight. The distribution of club head shell wall thickness will be defined later in the overall design optimization process of when all assemblies are put together.

Figure 8:
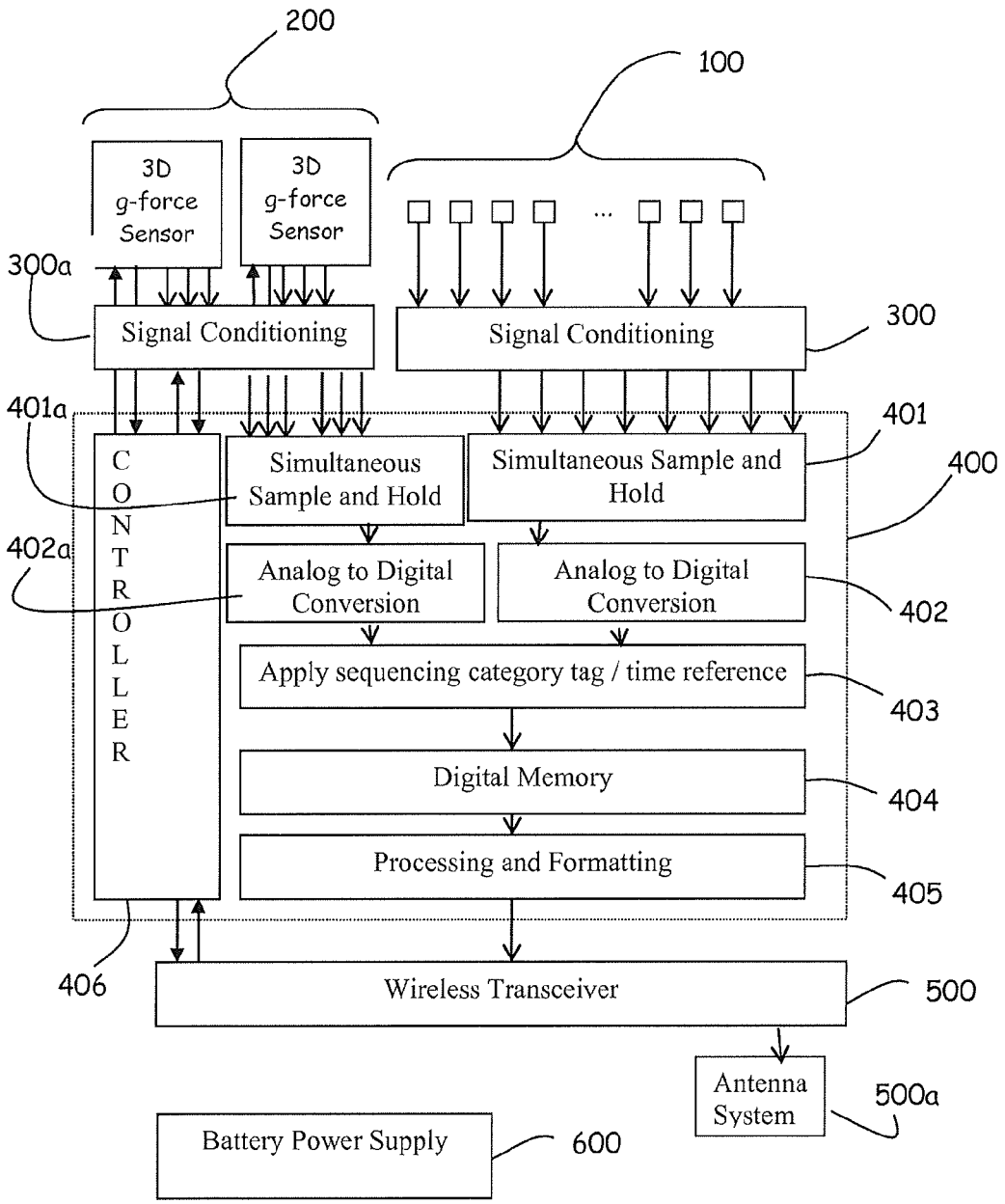
FIG. 8 is a block diagram of sensors and electronic processing functions and electronic support functions of integrated golf club of the present invention.

As shown in FIG. 8, the electronics assembly is the central processing and electrical connection hub for all other assemblies with electronic components. The two sensor categories, three dimensional g-force sensor(s) 200 and the pressure force sensors 100 are electrically connected to electronics that capture the time varying electrical signals of all of the sensors. The electrical signals may or may not use signal conditioning 300 and or 300*a* before they are input to sample and hold functions 401 and 401*a*. The sample and hold functions 401 or 401*a* samples all sensor(s) individually in a sensor category simultaneously at a rate defined for each sensor category. The sampling rate of each sensor category may be the same between sensor categories or may be different between sensor categories. Further the sampling rate of an individual sensor category may be constant or may be dynamically change during the golf swing based on logic triggers in the controller 406 associated with monitoring sensor levels of either one or both sensor categories. During the time duration that individual sample and hold stores sensor amplitude value in each of the sensor categories then analog to digital conversion function(s) 402 and or 402*a* takes each sample value and converts it to a digital representation. All of the digital samples for each sensor category are associated with that single sample time on a measurement time line of acquisition in "the apply sequencing sensor category tag and time reference" function 403 and then are moved into digital memory 404. The sampling rate for each sensor category of the simultaneous sample and hold function 401 and 401*a* are at, or faster than, the "Nyquist rate" determined by the highest pertinent frequency component associated with each sensor category. After all data has been loaded into memory storage 404 from a given golfer's swing, additional swing data can be captured and stored or the data is further processed and formatted 405 for transfer to a user interface function. All of the functions listed are coordinated by a controller function 406, which may be integrated together with other functions 400 such as a sophisticated PIC (Periphery Interface Control) module with DSP (Digital Signal Processing) functionality. In a preferred embodiment, the signal is processed and formatted 405 to be applied to a wireless transceiver 500 function. The wireless transceiver function includes electronic circuitry that provides electronic signals to an electrical drive port that is further connected to the antenna system 500*a* electrical input port(s). The antenna system emits and receives radio frequency waves for transfer of information between a remote user interface such as a laptop computer with wireless transceiver capabilities. All of the functions in FIG. 8 that require electrical power to function are supplied by an energy source such as battery power supply 600 that is detachable from the integrated golf club or rechargeable if it is implemented as a permanent component of the golf club head.

The electronics controller 406 dynamically organizes and controls the electrical sequencing and processing of the signals based on a fixed startup sequence and then triggers. When the integrated electronic system golf club head is initially turned on, the controller starts capturing and monitoring the g-force sensor(s) 20 measurement axes values form sensors 200. After startup the controller 406 comprises logic implemented with firmware residing and executing in controller 406 that defines a trigger events that may indicate for example weather the club head is moving or still or what portion of the swing is taking place based g-force sensor data. Further more complex triggers may be defined for triggers based on a combination of g-force sensor data and impact sensor data. Based on a predefined trigger events occurring the controller instructs electronic circuitry to individually or in any combination start or stop or adjust any operational function or combination of functions for example: memory storage of a given sensors category, wireless transmission, sample rate for individual sensor categories or any other electronic function affecting system operation and or mode of operation. The benefits of the of a system based on predefined logic triggers based on sensor inputs is the ability to optimize the state of operation of electronic function when needed to acquire the minimal amount of data to fully describe the desired swing characteristics and further reducing electronic function operations when not needed to minimize overall energy consumption. The lower overall energy consumption of the electronics allows for smaller lighter energy source or energy storage supply which contributes to the overall design flexibility of achieving an integrated electronics system golf club head with weight, center of gravity and physical structural performance similar to that of a regulation golf club head of similar type.

Figure 9:
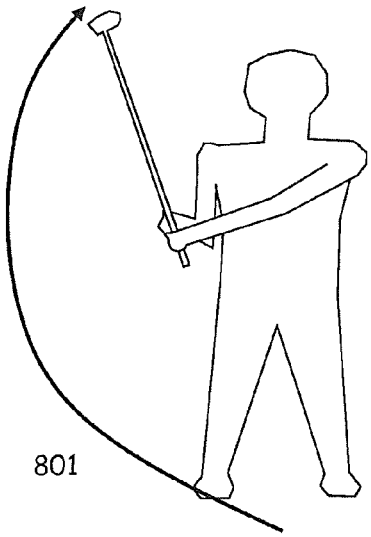
FIGS. 9, 9A, 9B and 9C details a golfer swing time lapse showing associated trigger points that control and alter data capture processing parameters within the electronics of the present invention
Figure 9A:
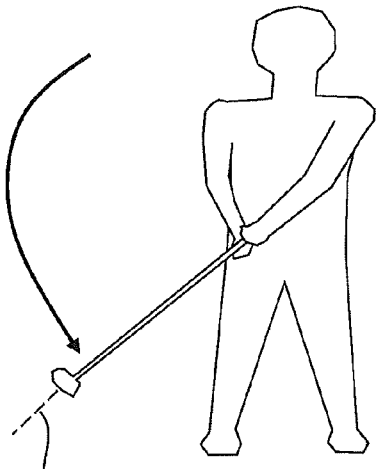
Figure 9B:
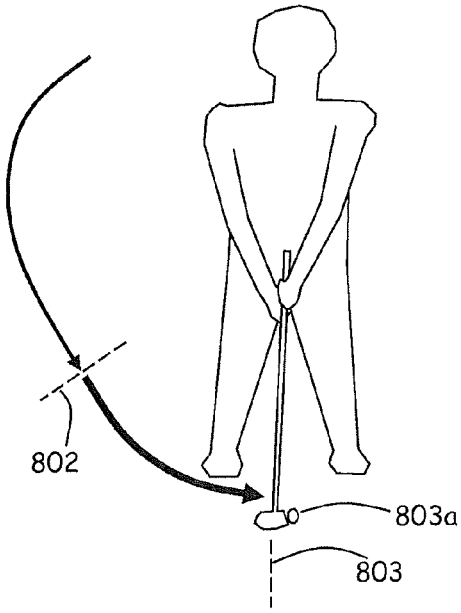
Figure 9C:
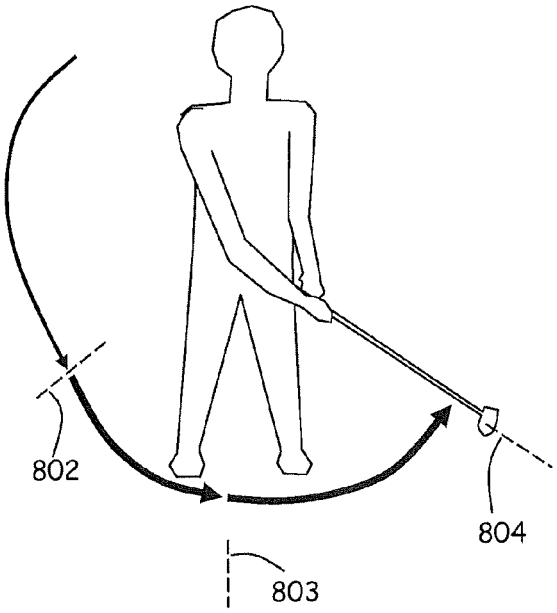

As shown in FIGS. 9, 9A, 9B, and 9C, the progression of a golf swing is shown to provide an example of how triggers may work by modifying electronic functions during the golf swing to provide all required information while reducing overall average energy consumption rate from battery source. This is only an example and numerous other trigger configurations are anticipated and would be obvious to a person of ordinary skill in the art after reviewing this example. FIG. 9 shows the golfer during the backswing 801 and only acceleration g-force sensor measurement are be captured at a predefined sampling rate and stored and transmitted. FIG. 9A shows the progression of the swing and at point 802 a predetermined trigger is invoked. The trigger's logic criteria is based on a combination of acceleration g-force measurements that determines the swing is substantially into the power-stroke and the invoked trigger causes the controller to increase the sampling rate of the g-force acceleration sensors and to start or initiate measuring and sampling and storing the impact force sensors at the predetermined rate and further transmitting synchronized time stamped measurements from memory storage of all sensors out of club head wirelessly. FIG. 9B shows further progression of the golf swing and another trigger is invoked at point 803 indicating the club head is making contact with the ball 803*a* based on impact sensor inputs. The invoked trigger that occurs at point 803 causes the controller to start a timer which after a predetermined time duration relating to location at position 804 shown in FIG. 9C shuts off the sampling and capture and storage of impact sensor measurements and further reduces the sampling rate of the acceleration g-force sensors. Further, wireless transmitter continues to transmit both g-force and impact sensor measurements from memory until all impact measurements in memory have been wirelessly transmitted out. Further wireless transceiver continues to transmit only acceleration g-force sensors data. Further and not shown in the figures, if golf club is set down and is not moving another trigger is invoked based on g-force sensor, and the wireless transmitter is shut off until time when movement is detected again invoking another trigger causing the wireless transmitter is turned back on.

The electronics assembly comprises input and output electrical connections to all other assemblies. As previously shown in FIG. 3 the other assemblies that have electrical connections to the electronics assembly 18 are: club face assembly impact sensors 30, g-force sensor assembly 29 for orthogonal acceleration measurements, antenna system assembly 27 and energy supply assembly 26. The electronics assembly comprises electronic components, integrated circuits and various electronic connectors assembled on a printed circuit board. The electronics assembly is optimized for minimal weight and volume while providing reliable predefined electronic functionality within an impact and shock environment. The size and weight of the electronics assembly is defined by the total aggregate weight of all pieces included in assembly with attachment vehicles such as solder. The design optimization process for electronic assembly include the steps of:

1. Define swing speed dynamics range for golf population targeted.
2. Define estimates of maximum impact forces that will be experienced by club head when ball club head impact take place.
3. Select electronic components and IC and connectors that provide required electronic functions and that are robust to function under shock estimates defined in step 2.
4. Layout printed circuit board for all electronics components
5. Assemble circuit board with all components, ICs and connectors to define electronics assembly
6. Record the default out port impedance inherent to an off the shelf RF circuitry such as an RF integrated circuit for use in antenna system design.
7. Measure electronics assemble to define size and weight
8. Define firmware code for electronic process and logic triggers to provide required data to describe swing characteristics and minimize overall current power consumption.
9. Define by measurement the average power consumption for a golf swing including all electronic processing functions of assembly including wireless transceiver functions with matched impedance load for intended frequency band.

The energy source assembly comprises components that facilitate the storage and release of energy to operate electronics. The energy source components may comprise various electrical components for enabling and disabling energy or power to electronics, connectors for electrically connecting to all electronics, and physical structure for assembly of all components and physical structure for supporting assembly either internal or external to club head shell cavity. The energy storage cells may be batteries or capacitors or supper capacitors or other component devices or combination of, that can store and release electrical energy. Further, batteries may be of rechargeable or disposable types.

The design optimization process for the energy source assembly focuses defining a design that has minimal weight and volume while providing operation of electronics for predetermined time duration. The energy source assembly design optimization process includes the steps of:

1. Define require time duration of operations such as training session or a round of golf.
2. Define total power requirements to operate all electrical power consuming assemblies associated with integrated electronics system golf club head.
3. Define the total energy required to supply power for time duration defined in step 1.
4. Define energy storage cell type and size and or number of energy storage cells required to provide total energy defined in step 3.
5. Define all electrical and physical support components required for energy cell(s) integrations
6. Define assembled energy assembly weight, volume and shape, and mass distribution.

Another assembly for purposes of energy harvesting may also be included in the integrated electronics system golf club head that harvest energy from the impact sensor elements generated power signal. The impact sensor elements may be made of piezoelectric materials that do not require a power supply to function. The piezoelectric elements, however, generate and provide an output voltage and current waveform when a force is applied to the elements such as the impact of a golf ball on the club face assembly. A portion of the generated electrical power signal comprising voltage and current from the impact sensor elements may be used to apply charge to an energy storage cell device in a recharging fashion. The portion of power signal extracted from the impact sensor element(s) is done in a ratio format, so the shape of the signal waveform from impact sensor elements applied to the processing electronics is not changed. Further with the ratio of signal amplitude extracted for recharging purposes known, no information carried by signal portion applied to electronics processing is lost.

The process of optimizing the overall assembly of the integrated electronics golf club head is focused on defining a system golf club head that has all measurements and electronic processing and communication capabilities desired and that functions substantially similar to regulation golf club head of similar type based on physical properties. Further, the specific physical properties being substantially similar include: coefficient of restitution of club face, overall weight of club head and center of gravity of club head. The system club head variables that are defined in this final optimization process include: placement of all assemblies, components and elements in relation to club head shell outer surface and in conjunction defining the club head shell wall thickness profile. The optimization process for the aggregation of all assemblies and structures for the integrated electronics system golf club head include the steps of:

1. Define what functions are to be included in system club head that defines what assemblies will be utilized in or on club head.
2. Define the shape, weight and mass distribution of utilized assemblies from previous optimization processes results for each individual assembly except antenna system.
3. In a CAD (Computer Aided Design) mechanical design tool such as Solidworks™, model each assembly as representative shape, volume and mass density for each assembly from step 2 except antenna system.
4. In CAD tool, model antenna system with club head shell structure with zero mass (zero wall thickness) and without club face assembly and having an outer surface shape or contour and all other elements and objects with mass defined in antenna optimization process.

5. In CAD tool attach club face assembly with antenna system assembly where club face assembly is attached to club head shell outer surface to form entire outer surface of club head system.
6. In CAD tool define an estimated spatial relation all assemblies from step 2 with in assembly antenna system shell shape and club face assembly forming cavity in step 5 that further results in a center of gravity of aggregate of all assemblies near intended center of gravity for overall club head system
7. Add wall thickness in a uniform manner consistent with earlier define material that has a defined mass density to define a club head system with desire overall weight consistent with a regulation golf club head of similar type.
8. Adjust in combination:
   a. wall thickness profile maintaining mass volume of material and outer surface structure of club head shell and
   b. spatial relationships of assemblies to club head shell outer surface to define the desired center of gravity of the overall club head system.
9. Defines an addition weight and mass distribution entity for mounting method and materials used for supporting internal assemblies in defined spatial relationship from step 8 that defines an addition weight and mass distribution entity.
10. Reduce or increase mass of material used for club head shell wall thickness and iterate through steps 8 and 9 until overall club head system desire weight and desired center of gravity are achieved.
11. Validate through CAD structural analysis that club head shell physical structure wall thickness and mounting methods support the physical stresses required for swinging and impact consistent with a golf club head in use as a golfing instrument.
12. If validation is successful optimization is complete. If validation fails alter both club head shell wall thickness profile structure to provide more structural support where needed using define mass allocation and iterate through steps 8-11.

As seen in the overall optimization process of the integrated electronics system golf club head design, the process requires providing structural integrity of club head shell structure with a predetermine weight that is less than a typical club head shell of similar type without additional assemblies. The club head wall thickness profile variable and the materials profile selected are the central control factors defining structural integrity within the confines of a predetermined weight limit.

Figure 10A:
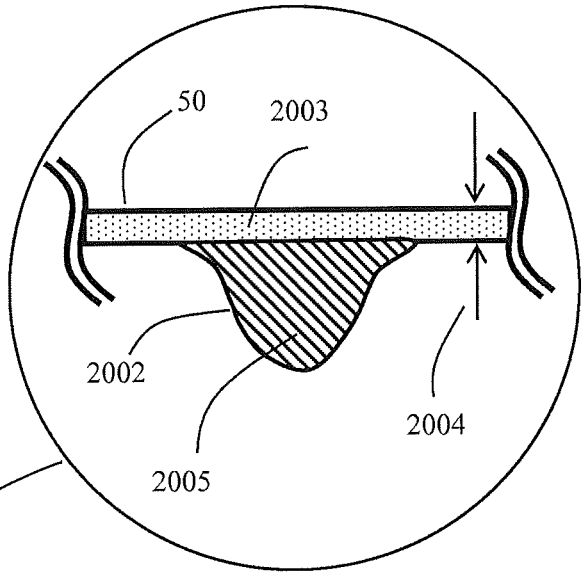
FIG. 10A is a cross-sectional view of club head shell wall of FIG. 10 showing a wall thickness profile structure embodiment comprising two separate materials.
Figure 10:
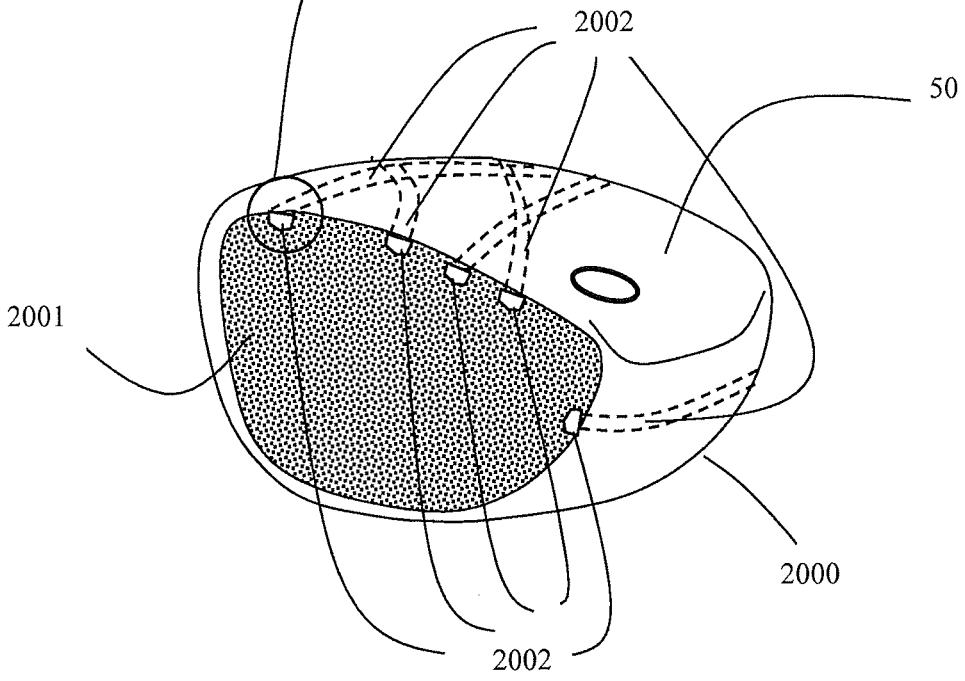
FIG. 10 is the club head shell showing club head wall with a varying wall thickness structure embodiment for optimizing weight, balance and structural integrity of overall club head shell.

FIG. 10 shows a club head shell 2000 with exemplary varying wall thickness profile type for the benefit of minimal weight and robust structural integrity. The club head shell 2000 (without the club face) has an outer surface 50 and an inner cavity 2001 and inner cavity 2001 has an inner surface (not labeled). This first embodiment of the club head shell structure defines a wall thickness profile that comprises areas of increased thickness and allows the predetermined and predefined outer surface 50 shape or contour to remain constant and unchanged. Exemplary areas of increased thickness 2002 are shown protruding into the inner cavity 2001 as interconnected ribs and are only shown for a small portion of the total shell for clarity of illustrative drawing purposes, however, would be implemented throughout the club head shell structure in predetermined area locations of the shell 2000 based on known applied stress and acceptable strain requirements. The areas of increased thickness 2002 in this example can be described as rib like structures that are similar to truss systems that provide large structure force support with a conservative use of materials. The areas of increased thickness 2002 or interconnected ribs adapted to be a truss like system provides structural resilience to stresses experienced by the club head shell, especially a ball impact on the club face and stress areas around the hosel connection. The areas of increased thickness 2002 or ribbed structural system allows forces acting on the club head shell to be distributed along interconnected ribs allowing the shell wall thickness between the ribs to be very thin for the benefit of weight and mass distribution control. The areas of increased thickness 2002 and the protrusion thickness differences as compared to areas of minimal wall thickness define a volume of material that may be made of any predetermined material that is the same as, or similar to, or non-similar to, the material of the outer surface 50 with electrically conductive properties. In this embodiment the material properties the said volume of material for areas of increased wall thickness are the same as the material properties of the outer surface 50. Further the minimal wall thickness of the club head shell with regards to antenna function purposes requires only a few microns to a few mils of thickness as defined by skin effects related to the material property of electrical conductivity of metal(s) or alloy(s) used for the outer surface. Therefore, the minimum thickness of the club head shell wall thickness covering and between the areas of increased thickness 2002 or ribs is dominated only by the requirement of structural enhancement through support of the ribs. The areas of increased thickness 2002 or ribbed structures and minimal thickness areas are described entirely with the wall thickness profile of the club head shell 2000. Further the areas of increased thickness 2002 or ribs system on inner portion of club head shell may be any predetermined three dimensional pattern(s) or non-symmetric design that meets the desired structural physical properties and weight and mass distribution goals of club head shell system.

As shown in FIG. 10A another embodiment of the club head shell structure utilizes multiple materials. FIG. 10 A shows a close up of a cross section view showing a multi material wall thickness profile structure. The first material 2003 is used for the club shell outer surface area 50 and the portion of the wall thickness profile from the surface area 50 to a depth into the wall defined by minimum wall thickness 2004. The first material 2003 is a material such as a metal or alloy that has electrically conductive properties required by the antenna system. The second material 2005 is used for areas of increased wall thickness 2002 and may be a light weight composite or other type material with high structural strength and low mass density for light weight structural support. Example of such materials may be but not limited to a resin based carbon fiber composite. The first material and second material may be attached with a high strength adhesive or other attachment bonding process.

The club head shell structure with predetermined varying wall thickness profile is modeled and designed as a single entity, however for manufacturing purposes the design is segmented into two or more pieces that are attached through welding or other process. An example of the segmented two pieces may be a crown and a base that allow attachment of other electronics based assemblies before attachment of crown and based and club face.

Figure 11:
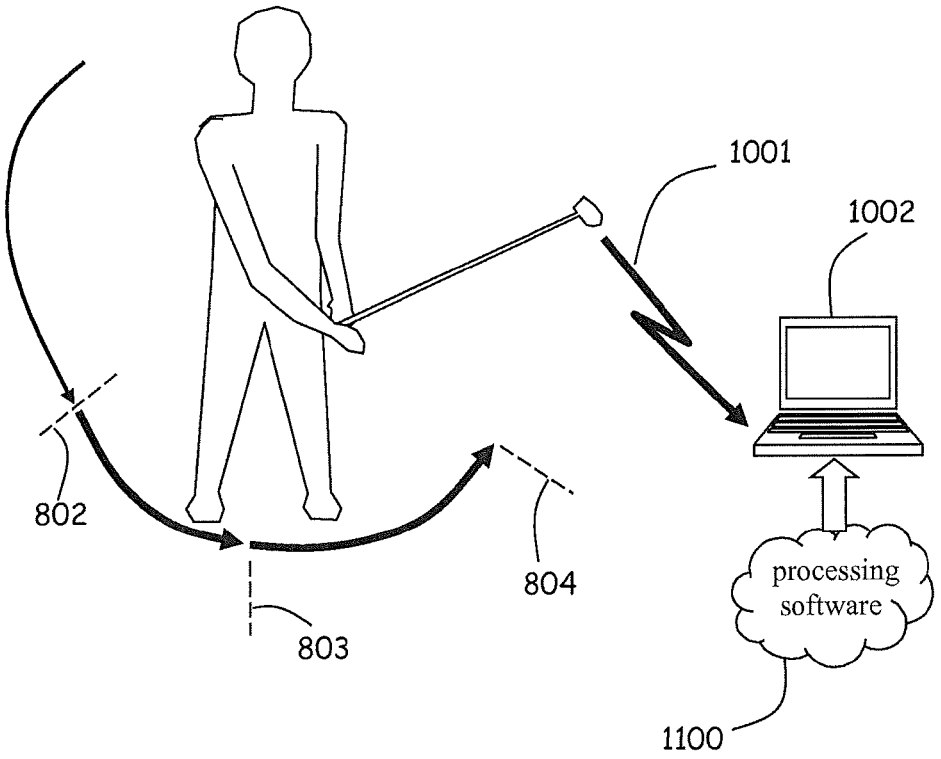
FIG. 11 details the present invention integrated golf club head attached to a golf club shaft transmitting captured swing and impact data to a remote user interface wirelessly to a laptop computer.

FIG. 11 shows a preferred embodiment of the invention. The golf club head is attached to a golf club shaft. The golf club system is then used as a measurements system that transmits the measured data from the golf club head to a remote user interface wirelessly 1001. The user human interface apparatus could be a smart phone, PDA, computer or custom wireless enabled thin or thick client device. In the preferred embodiment, the human interface apparatus is a laptop computer 1002. The laptop computer 1002 may have wireless abilities already built in for wireless communication such as WiFi, Bluetooth™, Zigbee™ or other standard or non-standard wireless protocols. If the laptop doesn't have integrated wireless hardware for a particular wireless protocol, a USB wireless adapter and associated software may be used. The laptop 1002 will have software 1100 running on it that is associated specifically with processing the time varying synchronized data from the golf club head into golf performance metrics for human interpretation in many different user selectable and definable formats.

Figure 12:
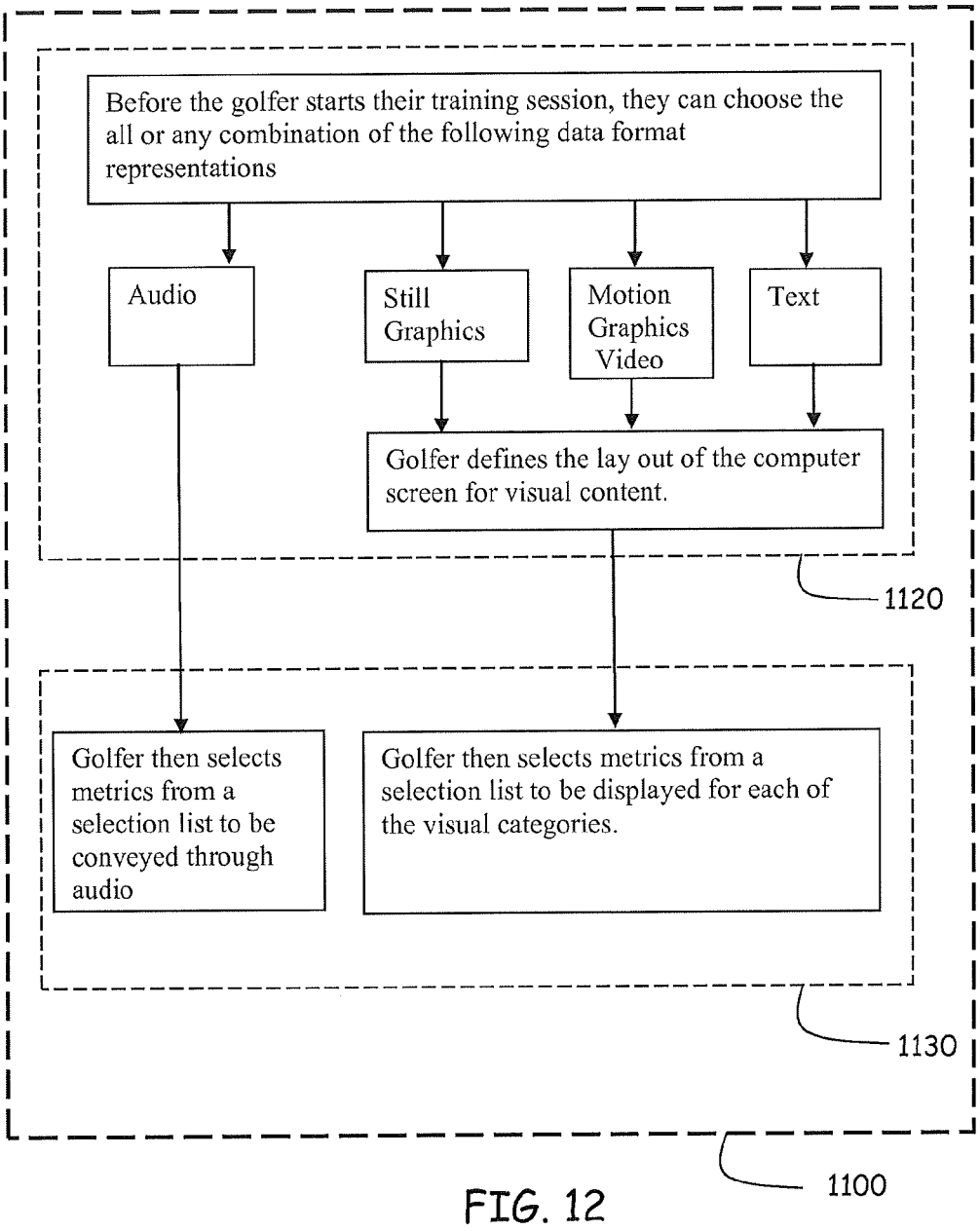
FIG. 12 is a block diagram of a user definable format portion of the data processing and human interface software running on a laptop computer of the present invention.

FIG. 12 shows the software 1100 capabilities and the structure of the program. The software 1100 will give great flexibility to the golfer as to how information is conveyed 1120 and what metrics information is/are conveyed 1130.

Figure 13:
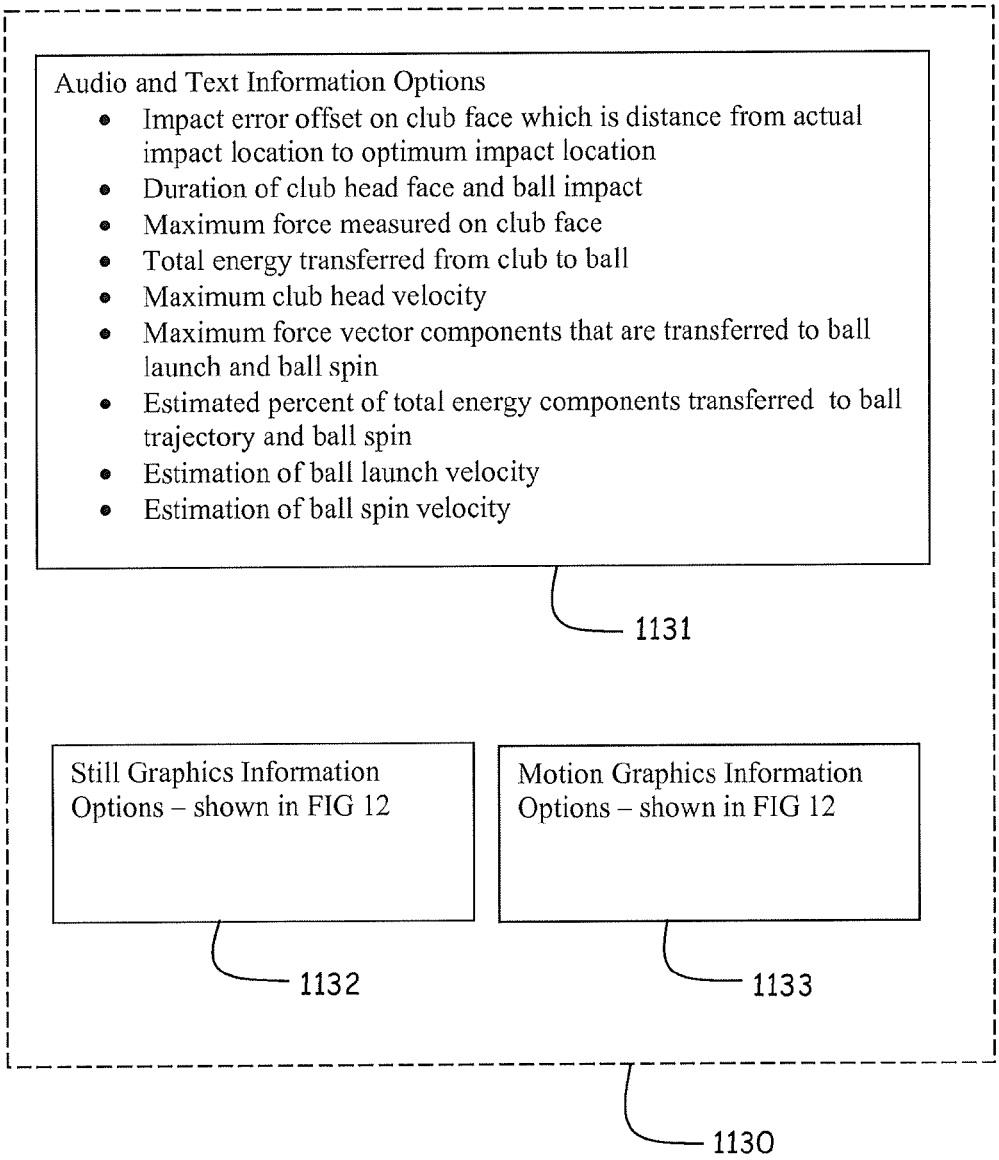
FIG. 13 is a block diagram of the present invention detailing user selectable content metrics that are available for the audio and text format options in the software.

As seen in FIG. 12 and further categorized in FIG. 13, the metrics information 1130 that can be conveyed is broken into four categories: (1) audio; (2) text; (3) still graphics; and (4) motion graphics which are time dilation sequenced graphics that would play as a time expanded video of various time varying metrics. Since the content that can be displayed in text is the same content that can be conveyed through audio, which are scalar values, these two groups of user selectable metrics can be combined 1131. The available content for the still graphic options 1132 and the motion graphics options 1133 are more complex, therefore they each have their own unique selectable metrics lists.

Figure 14:
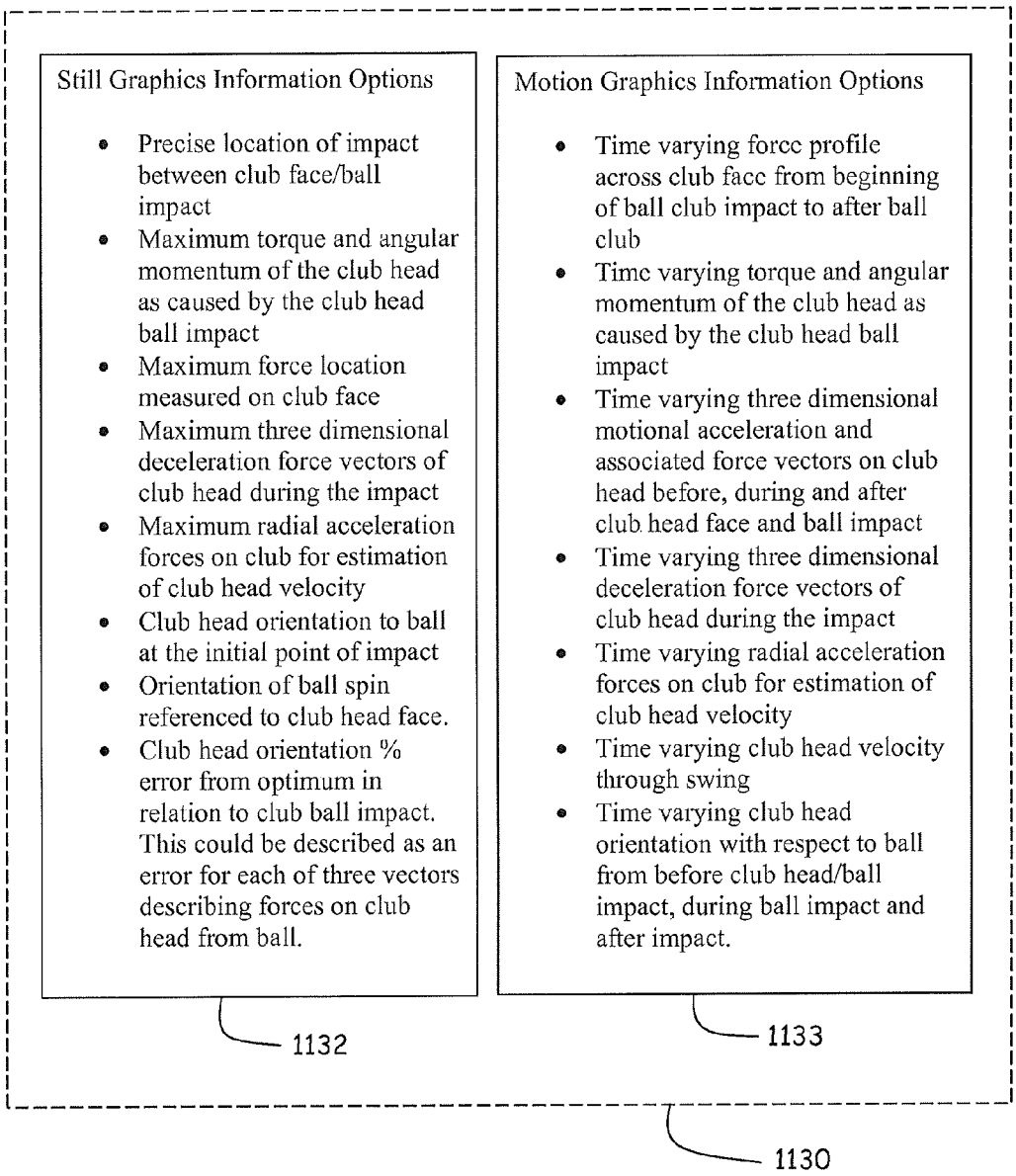
FIG. 14 a block diagram of the present invention detailing user selectable content metrics that are available for the still graphics and motion graphics format options in the software.

As shown in FIG. 14, the still graphic options 1132 and the motion graphics options 1133 are more complex in the sense they both convey three dimensional spatial metrics. However, the motion graphics 1133 adds the fourth dimension of time to create a powerful understanding for the golfer as to the dynamic nature of the metrics being presented.

Figure 15:
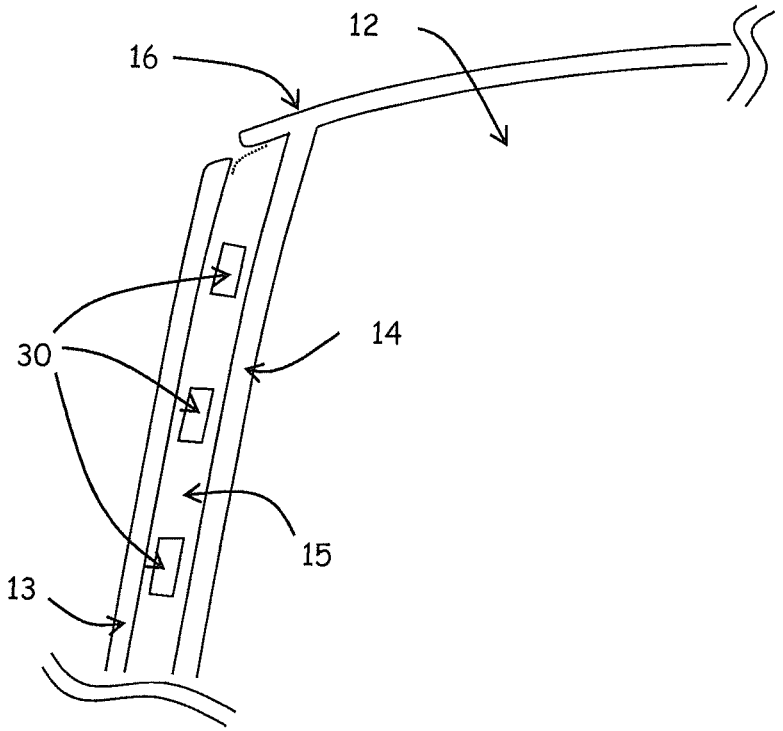
FIG. 15 is a partially exploded cross sectional view of an alternative embodiment of the club head face construction of the present invention showing two metal layers of which only the inner metal layer is rigidly attached to the club head housing.

FIG. 15 shows an alternative embodiment of the club head face construction where the outer metal layer 13 of the clubface 11 is not rigidly connected to the club head housing 16 and the inner layer 14 is rigidly connected the golf club head housing 16. The outer layer 13 is connected to the non-metallic, significantly hard monolith 15 that has the sensor array 30 embedded within it. The outer layer 13 is attached to the monolith material 15 with a strong durable adhesive. The monolith material 15 is also attached to the inner layer 14 with a durable adhesive. The inner layer 14 is rigidly connected to the club housing 16 with a welded seam as heretofore disclosed.

Figure 16:
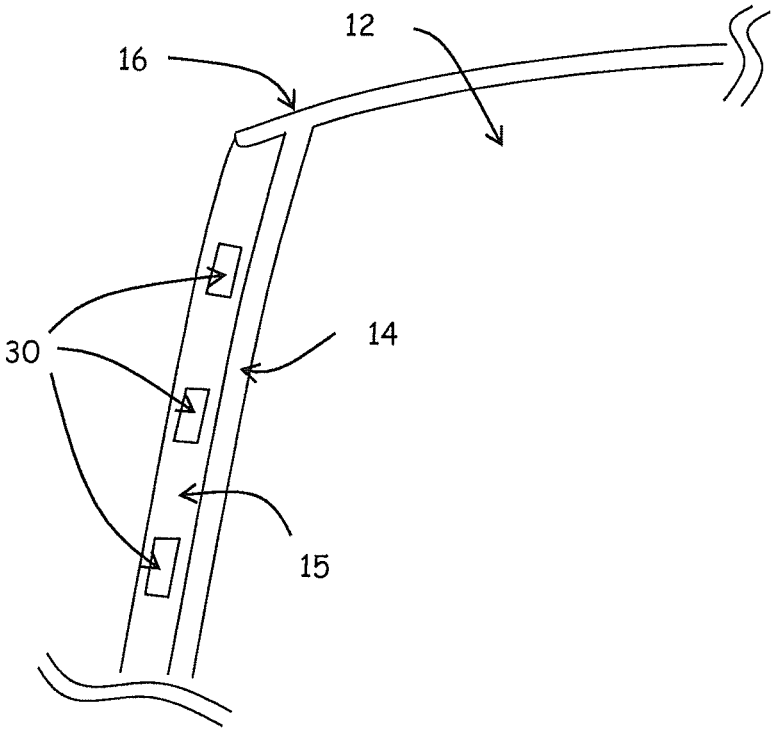
FIG. 16 is a partially exploded cross sectional view of an alternative embodiment of the club head face construction of the present invention showing a single metal layer and a hard material other than metal embedding the pressure force sensors that is the outer surface of the club head face.

FIG. 16 shows yet another embodiment of the club head face construction where there is only an inner metal layer 14 and the outer surface of the clubface 11 is the embedding material 15 that encapsulates the array of pressure force sensors 30. The embedding material 15 in this case is a non-conducting, very hard, durable non brittle material. Many materials exist that could be used and some example material families could be polycarbonates or very hard polymers. In this embodiment, the monolith material 15 is also attached to the inner layer 14 with a durable adhesive, while the inner layer 14 is rigidly connected to the club housing 16 with a welded seam.

Although specific embodiments of the invention have been disclosed, those having ordinary skill in the art will understand that changes can be made to the specific embodiments without departing form the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A golf club head, comprising:

a club face with at least one impact sensor and having an outline shape, the at least one sensor including a passive piezoelectric element and being integrated into a non conducting monolith layer that is substantially the same as the outline shape of the club face and further integrated into the club face, the at least one sensor operable to generate an impact signal when an impact force is applied to the club face, wherein the impact signal is generated during an entire duration of the impact force applied to the club face;

an energy storage assembly including at least one of a battery and a capacitor;

an energy harvesting assembly including a signal divider with at least one input and at least two outputs, the at least two outputs providing a ratio of the impact signal, wherein:

(1) the at least one input of the signal divider is electrically coupled to the at least one sensor, and (2) a first of the at least two outputs of the signal divider is electrically coupled to the energy storage assembly; and a signal processing assembly electrically coupled to a second of the at least two outputs of the signal divider and to an acceleration measurement assembly, wherein the signal processing assembly is operable to process signals, including at least one of sampling, digitizing, storing, formatting, and wireless transmission.

2. The golf club head of claim 1, further comprising:

an antenna including at least one electrically-conductive element, one of the at least one electrically-conducting elements being a surface of the golf club head.

3. The golf club head of claim 1, wherein the acceleration measurement assembly comprises at least one acceleration sensor and is operable to measure acceleration in three separate orthogonal axes.

4. The golf club head of claim 1, further comprising:

a hosel that is selectively detachable from a golf club shaft.

5. The golf club head of claim 1, wherein the second of the at least two outputs of the signal divider carries at least one signal indicative of an impact force between the club face and an object.

6. The golf club head of claim 1, wherein the second of the at least two outputs of the signal divider carries at least one signal indicative of characteristics of impact pressure forces experienced in a localized section of the club face.

7. The golf club head of claim 1, wherein the second of the at least two outputs of the signal divider carries at least one signal indicative of a spatial force profile across the club face's surface.

8. The golf club head of claim 1, wherein the second of the at least two outputs of the signal divider carries at least one signal indicative of a location of impact on the club face.

9. The golf club head of claim 1, wherein the second of the at least two outputs of the signal divider carries at least one signal indicative of the duration of impact on the club face.

10. The golf club head of claim 1, wherein the second of the at least two outputs of the signal divider carries at least one signal indicative of a dynamic time varying spatial force profile across the club face.

11. The golf club head of claim 1, wherein the passive piezoelectric element requires no electrical energy input to produce an electrical output.

12. The golf club head of claim 1, wherein the energy harvesting assembly includes the club face, the at least one impact sensor, electrical connections to the energy storage assembly, and supplies energy to active electronic components.

13. The golf club head of claim 1, wherein the signal divider divides the impact signal produced by the impact sensor and produces at least one output for signal processing and at least one output for providing energy to the energy storage assembly.

14. The golf club head of claim 1, wherein the ratio represents the impact signal produced by the impact sensor divided by an output of the signal divider.

15. The gold club head of claim 1, wherein a first portion of the impact signal is received by the energy storage assembly simultaneously with a second portion of the impact signal being received by the signal processing assembly.

16. A golf club head, comprising:

a club face with at least one impact sensor, the at least one sensor including a passive piezoelectric element and being integrated entirely into the club face, the at least one sensor operable to generate an impact signal when an impact force is applied to the club face, wherein the impact signal is generated during an entire duration of the impact force applied to the club face;

an energy storage assembly configured to store and release electrical energy to power at least one of a signal processing assembly configured to process at least a portion of the impact signal and an acceleration measurement assembly; and an energy harvesting assembly including a signal divider with at least one input and at least two outputs, the at least two outputs providing a ratio of the impact signal, wherein:

(1) the at least one input of the signal divider is electrically coupled to the at least one sensor, (2) a first of the at least two outputs of the signal divider is electrically coupled to the energy storage assembly, and (3) a second of the at least two outputs of the signal divider is electrically coupled to the signal processing assembly and to the acceleration measurement assembly.

17. The golf club head of claim 16, further comprising:

an antenna including at least one electrically-conductive element, one of the at least one electrically-conducting elements being a surface of the golf club head.

18. The golf club head of claim 16, wherein a first portion of the impact signal is received by the energy storage assembly simultaneously with a second portion of the impact signal being received by the signal processing assembly.

19. A golf club head, comprising:

a club face with at least one impact sensor, the at least one sensor including a passive piezoelectric element and being integrated into the club face, the at least one sensor operable to generate an impact signal when an impact force is applied to the club face;

an energy storage assembly configured to store and release electrical energy to power at least one of a signal processing assembly configured to process at least a portion of the impact signal and an acceleration measurement assembly; and an energy harvesting assembly including a signal divider with at least one input and at least two outputs, the at least two outputs providing a ratio of the impact signal, wherein:

(1) the at least one input of the signal divider is electrically coupled to the at least one sensor, (2) a first of the at least two outputs of the signal divider is electrically coupled to the energy storage assembly, and (3) a second of the at least two outputs of the signal divider is electrically coupled to the signal processing assembly and to the acceleration measurement assembly.

20. The golf club head of claim 19, wherein a first portion of the impact signal is received by the energy storage assembly simultaneously with a second portion of the impact signal being received by the signal processing assembly.

* * * * *